US009117418B2

(12) United States Patent
Zhang et al.

(10) Patent No.: US 9,117,418 B2
(45) Date of Patent: Aug. 25, 2015

(54) GATE DRIVER ON ARRAY (GOA) CIRCUIT AND DISPLAY PANEL WITH SAME

(71) Applicant: Shenzhen China Star Optoelectronics Technology Co., Ltd., Shenzhen, Guangdong (CN)

(72) Inventors: Shengdong Zhang, Shenzhen (CN); Zhijin Hu, Shenzhen (CN); Congwei Liao, Shenzhen (CN); Limei Zeng, Shenzhen (CN); Changyeh Lee, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 14/348,892

(22) PCT Filed: Jan. 24, 2014

(86) PCT No.: PCT/CN2014/071377

§ 371 (c)(1),
(2) Date: Mar. 31, 2014

(65) Prior Publication Data

US 2015/0206488 A1 Jul. 23, 2015

(30) Foreign Application Priority Data

Jan. 20, 2014 (CN) ..... 2014 1 0026204

(51) Int. Cl.
*G09G 3/36* (2006.01)

(52) U.S. Cl.
CPC ..... *G09G 3/3648* (2013.01); *G09G 2300/0465* (2013.01); *G09G 2300/0876* (2013.01); *G09G 2320/0209* (2013.01); *G09G 2320/045* (2013.01)

(58) Field of Classification Search
CPC . G09G 3/3648; G09G 3/3674; G09G 3/3677; G09G 2300/0465; G09G 2300/0876; G09G 2320/0209; G09G 2320/045
See application file for complete search history.

(56) References Cited

U.S. PATENT DOCUMENTS

2007/0001953 A1 1/2007 Jang et al.
2010/0260312 A1 * 10/2010 Tsai et al. ..... 377/79

(Continued)

FOREIGN PATENT DOCUMENTS

CN 101093647 A 12/2007
CN 102110406 A 6/2011

(Continued)

*Primary Examiner* — Adam R Giesy
(74) *Attorney, Agent, or Firm* — Andrew C. Cheng

(57) ABSTRACT

The present invention provides a gate driver on array (GOA) circuit and a display panel with the GOA circuit. The driver circuit includes multiple stages of gate driver units and multiple stages of supplementary gate driver units connected in cascade, in which the nth stage gate driver unit includes a driving unit (42) and a pull-down unit (44) and the mth stage supplementary gate driver unit includes a supplementary driving unit (52) and a supplementary pull-down unit (54). The GOA circuit according to the present invention adopts a dual-pull-down architecture so that thin-film transistors contained in pull-down units and supplementary pull-down units of the circuit can be set in an operation environment featuring dual polarity electrical biasing to effectively suppress threshold voltage drifting of the thin-film transistors of the pull-down units and the supplementary pull-down units and extend the lifespan of circuit thereby making the circuit better meet the needs of large- and medium-sized display panels. Further, the circuit has a simple structure and reduced power consumption and is also fit to low temperature and high temperature operations.

19 Claims, 21 Drawing Sheets

(56) References Cited

U.S. PATENT DOCUMENTS

| | | | | |
|---|---|---|---|---|
| 2012/0320021 | A1* | 12/2012 | Chang et al. | 345/211 |
| 2014/0103983 | A1* | 4/2014 | Chang et al. | 327/198 |

FOREIGN PATENT DOCUMENTS

| | | | |
|---|---|---|---|
| CN | 102855938 | A | 1/2013 |
| CN | 102867469 | A | 1/2013 |

* cited by examiner

GATE DRIVER ON ARRAY (GOA) CIRCUIT AND DISPLAY PANEL WITH SAME

BACKGROUND OF THE INVENTION

1. Field of the Invention

The present invention relates to the field of displaying technique, and in particular to a gate driver of array (GOA) circuit and a display panel with the GOA circuit.

2. the Related Arts

Liquid crystal displays (LCDs) have various advantages, including thin device body, saving power, and being free of radiation, and are thus widely used. Most of the liquid crystal displays that are currently available in the market are projection type liquid crystal displays, which comprise a liquid crystal panel and a backlight module. The principle of operation of the liquid crystal panel is that liquid crystal molecules are arranged between two parallel glass substrates and a driving voltage is applied to the two glass substrates to control the rotation direction of the liquid crystal molecules in order to modulate light emission of the backlight module for generating an image.

The recent development of the liquid crystal displays is in a trend toward high degree of integration and low cost and gate driver on array (GOA) becomes a hot spot of the researches of flat panel displaying technology. A GOA circuit is that peripheral circuits, such as gate driver circuits and data driver circuits, are manufactured with thin-film transistors (TFTs) and are formed a TFT substrate in combination with pixel TFTs. Compared to the conventional IC driving solutions, adopting the GOA solution helps reduce the number and the packaging processes of the peripheral driver chips and lower down the cost, and also make the periphery of a display thinner, the display module more compact, and mechanical and electrical properties enhanced. Among the techniques, GOA circuits based on amorphous silicon thin-film transistor has been widely researched, for, on the one hand, the amorphous silicon TFT techniques possesses advantages of low operation temperature, excellent device uniformity, and low cost, making them the mainstream TFT techniques, and, on the other hand, the amorphous silicon TFT possesses mobility that suits the requirement of gate driver circuits for operation frequency. However, the amorphous silicon TFT has poor stability and may suffer severe threshold voltage drifting when biased long voltage stress, seriously affecting the service life of the circuit.

In the GOA circuit, it generally needs a pull-down circuit to maintain an output single of the circuit at a low level. The pull-down circuit comprises a pull-down TFT that is often subjected to voltage stress for a long time, making it a key component that affects the service life of the GOA circuit. A known design of a GOA circuit adopts solutions, such as low voltage direct current biasing, dual pull-down structure, high frequency pulse biasing, or reducing duty ratio of voltage signal, to achieve the purpose of extending service life of the GOA circuit. These solutions may achieve the purpose of extending the service life of the GOA circuit to some extents; however, the pull-down TFT, which is constantly under biasing of a single polarity (the voltage being positive), is long acted upon by direct current voltage stress of positive polarity or pulse voltage stress, so that after having been operated for a long time, the pull-down TFT may be susceptible to great threshold voltage drifting and may result in deterioration of electrical conductivity, thereby severely affecting the service life of the GOA circuit. In the applications of large- or medium-sized panel displaying, the GOA circuit must be set in an operation condition for an extremely long time and this makes the requirement for circuit lifespan more severe. Thus, it is a key issue for designing GOA for television panels to effectively suppress threshold voltage drifting of a key TFT in a circuit so as to extend the lifespan of a GOA circuit to suit the need for large- and medium-sized panel displaying.

SUMMARY OF THE INVENTION

An object of the present invention is to provide a pixel structure, which can effectively increase aperture ratio under the condition that vertical crosstalk is effectively prevented.

Another object of the present invention is to provide a liquid crystal panel, which has a large aperture ratio and excellent displaying performance.

To achieve the objects, the present invention provides a GOA (Gate Drive on Array) circuit, which comprises multiple stages of the gate driver units and multiple stages of the supplementary gate driver units connected in cascade, wherein:

a nth stage gate driver unit comprises a (n−2)th signal input terminal, a (n+1)th signal input terminal, a (n+3)th signal input terminal, a high-frequency clock signal first input terminal, a low-frequency clock signal first input terminal, a low-frequency clock signal second input terminal, a low level input terminal, a first output terminal, and a second output terminal, wherein the first output terminal of the nth stage array substrate row driving unit functions to drive a pixel zone of a display panel;

a mth stage supplementary gate driver unit comprises a (m−1)th supplementary signal input terminal, a high-frequency clock signal first input terminal, a high-frequency clock signal second input terminal, a low-frequency clock signal first input terminal, a low-frequency clock signal second input terminal, a low level input terminal, a first supplementary output terminal, and a second supplementary output terminal;

when the nth stage gate driver unit is one of the fourth stage to the fourth last stage gate driver unit, the (n−2)th signal input terminal of the nth stage gate driver unit is electrically connected to the first output terminal of the (n−2)th stage gate driver unit; the (n+1)th signal input terminal of the nth stage gate driver unit is electrically connected to the second output terminal of the (n−1)th stage gate driver unit; the (n+3)th signal input terminal of the nth stage gate driver unit is electrically connected to the first output terminal of the (n+3)th stage gate driver unit; the first output terminal of the nth stage gate driver unit is electrically connected to the (n−2)th signal input terminal of the (n+2)th stage gate driver unit and the (n+3)th signal input terminal of the (n−3)th stage gate driver unit; and the second output terminal of the nth stage gate driver unit is electrically connected to the (n+1)th signal input terminal of the (n−1)th stage gate driver unit;

when the nth stage gate driver unit is the first stage gate driver unit, the (n−2)th signal input terminal of the nth stage gate driver unit functions to receive an input of a pulse excitation signal; the (n+1)th signal input terminal of the nth stage gate driver unit is electrically connected to the second output terminal of the (n−1)th stage gate driver unit; the (n+3)th signal input terminal of the nth stage gate driver unit is electrically connected to the first output terminal of the (n+3)th stage gate driver unit; the first output terminal of the nth stage gate driver unit is electrically connected to the (n−2)th signal input terminal of the (n+2)th stage gate driver unit; and the second output terminal of the nth stage gate driver unit is floating;

when the nth stage gate driver unit is the second stage gate driver unit, the (n−2)th signal input terminal of the nth stage gate driver unit functions to receive an input of a pulse excitation signal; the (n+1)th signal input terminal of the nth stage gate driver unit is electrically connected to the second output terminal of the (n+1)th stage gate driver unit; the (n+3)th signal input terminal of the nth stage gate driver unit is electrically connected to the first output terminal of the (n+3)th stage gate driver unit; the first output terminal of the nth stage gate driver unit is electrically connected to the (n−2)th signal input terminal of the (n+2)th stage gate driver unit; and the second output terminal of the nth stage gate driver unit is electrically connected to the (n+1)th signal input terminal of the (n−1)th stage gate driver unit;

when the nth stage gate driver unit is the third stage gate driver unit, the (n−2)th signal input terminal of the nth stage gate driver unit is electrically connected to the first output terminal of the (n−2)th stage gate driver unit; the (n+1)th signal input terminal of the nth stage gate driver unit is electrically connected to the second output terminal of the (n−1)th stage gate driver unit; the (n+3)th signal input terminal of the nth stage gate driver unit is electrically connected to the first output terminal of the (n+3)th stage gate driver unit; the first output terminal of the nth stage gate driver unit is electrically connected to the (n−2)th signal input terminal of the (n+2)th stage gate driver unit; and the second output terminal of the nth stage gate driver unit is electrically connected to the (n+1)th signal input terminal of the (n−1)th stage gate driver unit;

when the nth stage gate driver unit is the third last stage gate driver unit, the (n−2)th signal input terminal of the nth stage gate driver unit is electrically connected to the first output terminal of the (n−2)th stage gate driver unit; the (n+1)th signal input terminal of the nth stage gate driver unit is electrically connected to the second output terminal of the (n+1)th stage gate driver unit; the (n+3)th signal input terminal of the nth stage gate driver unit is electrically connected to the first supplementary output terminal of the first stage supplementary gate driver unit; the first output terminal of the nth stage gate driver unit is electrically connected to the (n−2)th signal input terminal of the (n+2)th stage gate driver unit and the (n+3)th signal input terminal of the (n−3)th stage gate driver unit; and the second output terminal of the nth stage gate driver unit is electrically connected to the (n+1)th signal input terminal of the (n−1)th stage gate driver unit;

when the nth stage gate driver unit is the second last stage gate driver unit, the (n−2)th signal input terminal of the nth stage gate driver unit is electrically connected to the first output terminal of the (n−2)th stage gate driver unit; the (n+1)th signal input terminal of the nth stage gate driver unit is electrically connected to the second output terminal of the (n−1)th stage gate driver unit; the (n+3)th signal input terminal of the nth stage gate driver unit is electrically connected to the first supplementary output terminal of the second stage supplementary gate driver unit; the first output terminal of the nth stage gate driver unit is electrically connected to the (n+3)th signal input terminal of the (n−3)th stage gate driver unit; and the second output terminal of the nth stage gate driver unit is electrically connected to the (n+1)th signal input terminal of the (n−1)th stage gate driver unit;

when the nth stage gate driver unit is the last stage gate driver unit, the (n−2)th signal input terminal of the nth stage gate driver unit is electrically connected to the first output terminal of the (n−2)th stage gate driver unit; the (n+1)th signal input terminal of the nth stage gate driver unit is electrically connected to the second supplementary output terminal of the first stage supplementary gate driver unit; the (n+3)th signal input terminal of the nth stage gate driver unit is electrically connected to the first supplementary output terminal of the third stage supplementary gate driver unit; the first output terminal of the nth stage gate driver unit is electrically connected the (n+3)th signal input terminal of the (n−3)th stage gate driver unit and the (m−1)th supplementary signal input terminal of the first stage supplementary gate driver unit; and the second output terminal of the nth stage gate driver unit is electrically connected to the (n+1)th signal input terminal of the (n−1)th stage gate driver unit;

when the mth stage supplementary gate driver unit is one of the fourth stage to the last stage supplementary gate driver unit, the (m−1)th supplementary signal input terminal of the mth stage supplementary gate driver unit is electrically connected to the first supplementary output terminal of the (m−1)th stage supplementary gate driver unit; the first supplementary output terminal of the mth stage supplementary gate driver unit is electrically connected to the (m−1)th supplementary signal input terminal of the (m+1)th stage supplementary gate driver unit; and the second supplementary output terminal is floating;

when the mth stage supplementary gate driver unit is the first stage supplementary gate driver unit, the (m−1)th supplementary signal input terminal of the mth stage supplementary gate driver unit is electrically connected to the first output terminal of the last stage gate driver unit; the first supplementary output terminal of the mth stage supplementary gate driver unit is electrically connected to the (m−1)th supplementary signal input terminal of the (m+1)th stage supplementary gate driver unit and the (n+3)th signal input terminal of the third last stage gate driver unit; and the second supplementary output terminal is electrically connected to the (n−1)th signal input terminal of the last stage gate driver unit;

when the mth stage supplementary gate driver unit is the second stage supplementary gate driver unit, the (m−1)th supplementary signal input terminal of the mth stage supplementary gate driver unit is electrically connected to the first supplementary output terminal of the (m−1)th stage supplementary gate driver unit; the first supplementary output terminal of the mth stage supplementary gate driver unit is electrically connected to the (m−1)th supplementary signal input terminal of the (m+1)th stage supplementary gate driver unit and the (n+3)th signal input terminal of the second last stage gate driver unit; and the second supplementary output terminal is floating;

when the mth stage supplementary gate driver unit is the third stage supplementary gate driver unit, the (m−1)th supplementary signal input terminal of the mth stage supplementary gate driver unit is electrically connected to the first supplementary output terminal of the (m−1)th stage supplementary gate driver unit; the first supplementary output terminal of the mth stage supplementary gate driver unit is electrically connected to the (m−1)th supplementary signal input terminal of the (m+1)th stage supplementary gate driver unit and the (n+3)th signal input terminal of the last stage gate driver unit; and the second supplementary output terminal is floating;

the nth stage gate driver unit of the GOA circuit further comprises:

a driving unit, which is electrically connected to the (n−2)th signal input terminal, the high-frequency clock signal first input terminal, the (n+3)th signal input terminal, the first output terminal, and the second output terminal; and a pull-down unit, which is electrically connected to the (n+1)th signal input terminal, the low-frequency clock signal first input terminal, the low-frequency clock signal second input terminal, the low level input terminal, and the driving unit;

the mth stage supplementary gate driver unit of the GOA circuit further comprises:

a supplementary driving unit, which is electrically connected to the (m−1)th supplementary signal input terminal, the high-frequency clock signal first input terminal, the high-frequency clock signal second input terminal, the first supplementary output terminal, and the second supplementary output terminal; and a supplementary pull-down unit, which is electrically connected to the low-frequency clock signal first input terminal, the low-frequency clock signal second input terminal, the low level input terminal, and the supplementary driving unit.

The low level input terminal receives an input signal that is a low level signal; the high-frequency clock signal first input terminal and the high-frequency clock signal second input terminal receive an input signal that is a first high-frequency clock signal, a second high-frequency clock signal, a third high-frequency clock signal, or a fourth high-frequency clock signal, in which the first high-frequency clock signal and the third high-frequency clock signal are of opposite phases, the second high-frequency clock signal and the fourth high-frequency clock signal are of opposite phases, and the first high-frequency clock signal and the third high-frequency clock signal are of waveforms that are identical in shape to but different in initial phase from waveforms of the second high-frequency clock signal and the fourth high-frequency clock signal;

when the input signal of the high-frequency clock signal first input terminal of the nth stage gate driver unit of the GOA circuit is the first high-frequency clock signal, the input signals of the high-frequency clock signal first input terminals of the (n+1)th stage, the (n+2)th stage, and the (n+3)th stage gate driver units are respectively the second, the third, and the fourth high-frequency clock signals;

when the input signals of the high-frequency clock signal first input terminal and the high-frequency clock signal second input terminal of the mth stage supplementary gate driver unit of the GOA circuit are respectively the kth and the (k−1)th clock signals, the input signals of the high-frequency clock signal first input terminal and the high-frequency clock signal second input terminal of the (m+1)th stage supplementary gate driver unit of the GOA circuit are respectively the (k+1)th and the kth clock signals, wherein the value of k is from 1 to 4 and when k is 1, the value of k−1 is set to 4, and when k is 4, the value of k+1 is set to 1;

the low-frequency clock signal first input terminal and the low-frequency clock signal second input terminal receive input signals that are respectively a first low-frequency clock signal and a second low-frequency clock signal, wherein the first low-frequency clock signal and the second low-frequency clock signal are of complementary voltages;

when the input signals of the low-frequency clock signal first input terminal and the low-frequency clock signal second input terminal of the nth stage gate driver unit of the GOA circuit are respectively the first low-frequency clock signal and the second low-frequency clock signal, the input signals of the low-frequency clock signal first input terminal and the low-frequency clock signal second input terminal of the (n+1)th stage gate driver unit are respectively the second low-frequency clock signal and the first low-frequency clock signal; and when the input signals of the low-frequency clock signal first input terminal and the low-frequency clock signal second input terminal of the mth stage supplementary gate driver unit of the GOA circuit are respectively the first low-frequency clock signal and the second low-frequency clock signal, the input signals of the low-frequency clock signal first input terminal and the low-frequency clock signal second input terminal of the (m+1)th stage supplementary gate driver unit are respectively the second low-frequency clock signal and the first low-frequency clock signal.

The driving unit comprises a capacitor, a first TFT (Thin-Film Transistor), a second TFT, and a third TFT; wherein the first TFT comprises a first gate terminal, a first source terminal, and a first drain terminal; the second TFT comprises a second gate terminal, a second source terminal, and a second drain terminal; the third TFT comprises a third gate terminal, a third source terminal, and a third drain terminal; the first gate terminal and the first drain terminal are electrically connected to the (n−2)th signal input terminal; the first source terminal is electrically connected to one end of the capacitor, the second gate terminal, the third drain terminal, the second output terminal, and the pull-down unit; the second drain terminal is electrically connected to the high-frequency clock signal first input terminal; the second source terminal is electrically connected to an opposite end of the capacitor, the first output terminal, and the pull-down unit; the third gate terminal is electrically connected to the (n+3)th signal input terminal; the third source terminal is electrically connected to the low level input terminal;

the supplementary driving unit comprises a supplementary capacitor, a twenty-first thin-film transistor, a twenty-second thin-film transistor, and a twenty-third thin-film transistor, wherein the twenty-first thin-film transistor comprises a twenty-first gate terminal, a twenty-first source terminal, and a twenty-first drain terminal; the twenty-second thin-film transistor comprises a twenty-second gate terminal, a twenty-second source terminal, and a twenty-second drain terminal; the twenty-third thin-film transistor comprises a twenty-third gate terminal, a twenty-third source terminal, and a twenty-third drain terminal; the twenty-first gate terminal, the twenty-first drain terminal, and the twenty-second drain terminal are electrically connected to the (m−1)th supplementary signal input terminal; the twenty-first source terminal is electrically connected to one end of the supplementary capacitor, the twenty-third gate terminal, the twenty-second source terminal, the second supplementary output terminal, and the supplementary pull-down unit; the twenty-second gate terminal is electrically connected to the high-frequency clock signal second input terminal; the twenty-third drain terminal is electrically connected to the high-frequency clock signal first input terminal; the twenty-third source terminal is electrically connected to an opposite end of the supplementary capacitor, the first supplementary output terminal, and the supplementary pull-down unit.

The pull-down unit comprises a first pull-down unit, a first pull-down signal generation unit, a second pull-down unit, and a second pull-down signal generation unit, wherein the first pull-down unit is electrically connected to the driving unit, the first pull-down signal generation unit, the second pull-down unit, and the low level input terminal; the first pull-down signal generation unit is electrically connected to the first pull-down unit, the low-frequency clock signal first input terminal, the low-frequency clock signal second input terminal, and the low level input terminal; the second pull-down unit is electrically connected to the driving unit, the second pull-down signal generation unit, the first pull-down unit, and the low level input terminal; and the second pull-down signal generation unit is electrically connected to the second pull-down unit, the low-frequency clock signal first input terminal, the low-frequency clock signal second input terminal, and the low level input terminal;

the first pull-down unit comprises a fourth TFT and a fifth TFT, wherein the fourth TFT comprises a fourth gate terminal, a fourth source terminal, and a fourth drain terminal; the fifth TFT comprises a fifth gate terminal, a fifth source terminal, and a fifth drain terminal; the fourth gate terminal and the fifth gate terminal are electrically connected to the first pull-down signal generation unit; the fourth drain terminal is electrically connected to the first source terminal, the one end of the capacitor, the second gate terminal, the third drain terminal, the second output terminal, the second pull-down signal generation unit, and the second pull-down unit; the fourth source terminal and the fifth source terminal are electrically connected to the low level input terminal; the fifth drain terminal is electrically connected to the second source terminal, the opposite end of the capacitor, the first output terminal, and the second pull-down unit;

the second pull-down unit comprises a sixth TFT and a seventh TFT, wherein the sixth TFT comprises a sixth gate terminal, a sixth source terminal, and a sixth drain terminal and the seventh TFT comprises a seventh gate terminal, a seventh source terminal, and a seventh drain terminal; the sixth gate terminal and the seventh gate terminal are electrically connected to the second pull-down signal generation unit; the sixth source terminal and the seventh source terminal are electrically connected to the low level input terminal; the sixth drain terminal is electrically connected to the first source terminal, the one end of the capacitor, the second gate terminal, the third drain terminal, the fourth drain terminal, the second output terminal, and the second pull-down signal generation unit; the seventh source terminal is electrically connected to the second source terminal, the opposite end of the capacitor, the first output terminal, and the fifth drain terminal;

the first pull-down signal generation unit comprises an eighth TFT, a ninth TFT, a tenth TFT, an eleventh TFT, and a twelfth TFT, wherein the eighth TFT comprises an eighth gate terminal, an eighth source terminal, and an eighth drain terminal; the ninth TFT comprises a ninth gate terminal, a ninth source terminal, and a ninth drain terminal; the tenth TFT comprises a tenth gate terminal, a tenth source terminal, and a tenth drain terminal; the eleventh TFT comprises an eleventh gate terminal, an eleventh source terminal, and an eleventh drain terminal; the twelfth TFT comprises a twelfth gate terminal, a twelfth source terminal, and a twelfth drain terminal; the eighth gate terminal, the eighth drain terminal, the ninth drain terminal, and the tenth gate terminal are electrically connected to the low-frequency clock signal second input terminal; the eighth source terminal is electrically connected to the ninth source terminal, the tenth drain terminal, the fourth gate terminal, and the fifth gate terminal; the tenth source terminal is electrically connected to the eleventh drain terminal and the twelfth drain terminal; the eleventh gate terminal is electrically connected to the first source terminal, the one end of the capacitor, the second gate terminal, the third drain terminal, the fourth drain terminal, the sixth drain terminal, and the second output terminal; the eleventh source terminal and the twelfth source terminal are electrically connected to the low level input terminal; the twelfth gate terminal is electrically connected to the (n+1)th signal input terminal; and the second pull-down signal generation unit comprises a fourteenth thin-film transistor, a fifteenth thin-film transistor, a sixteenth thin-film transistor, a seventeenth thin-film transistor, and an eighteenth thin-film transistor, wherein the fourteenth thin-film transistor comprises a fourteenth gate terminal, a fourteenth source terminal, and a fourteenth drain terminal; the fifteenth thin-film transistor comprises a fifteenth gate terminal, a fifteenth source terminal, and a fifteenth drain terminal; the sixteenth thin-film transistor comprises a sixteenth gate terminal, a sixteenth source terminal, and a sixteenth drain terminal; the seventeenth thin-film transistor comprises a seventeenth gate terminal, a seventeenth source terminal, and a seventeenth drain terminal; the eighteenth thin-film transistor comprises an eighteenth gate terminal, an eighteenth source terminal, and an eighteenth drain terminal; the fourteenth gate terminal, the fourteenth drain terminal, the fifteenth drain terminal, and the sixteenth gate terminal are electrically connected to the low-frequency clock signal first input terminal; the fourteenth source terminal is electrically connected to the fifteenth source terminal, the sixteenth drain terminal, the sixth gate terminal, and the seventh gate terminal; the sixteenth source terminal is electrically connected the seventeenth drain terminal and the eighteenth drain terminal; the seventeenth gate terminal is electrically connected to the eleventh gate terminal, the first source terminal, the one end of the capacitor, the second gate terminal, the third drain terminal, the fourth drain terminal, the sixth drain terminal, and the second output terminal; the seventeenth source terminal and the eighteenth source terminal are electrically connected to the low level input terminal; the eighteenth gate terminal is electrically connected to the (n+1)th signal input terminal.

The ninth gate terminal is electrically connected to the low-frequency clock signal first input terminal; and the fifteenth gate terminal is electrically connected to the low-frequency clock signal second input terminal.

The ninth gate terminal is electrically connected to the eighth source terminal, the ninth source terminal, the tenth drain terminal, the fourth gate terminal, and the fifth gate terminal; and the fifteenth gate terminal is electrically connected to the fourteenth source terminal, the fifteenth source terminal, the sixteenth drain terminal, the sixth gate terminal, and the seventh gate terminal.

The first pull-down signal generation unit further comprises a thirteenth thin-film transistor, wherein the thirteenth thin-film transistor comprises a thirteenth gate terminal, a thirteenth source terminal, and a thirteenth drain terminal; the thirteenth gate terminal is electrically connected to the first gate terminal, the first drain terminal, and the (n−2)th signal input terminal; the thirteenth drain terminal is electrically connected to the tenth source terminal, the eleventh drain terminal, and the twelfth drain terminal; the thirteenth source terminal is electrically connected to the low level input terminal; and the second pull-down signal generation unit further comprises a nineteenth thin-film transistor, wherein the nineteenth thin-film transistor comprises a nineteenth gate terminal, a nineteenth source terminal, and a nineteenth drain terminal; the nineteenth gate terminal is electrically connected to the thirteenth gate terminal, the first gate terminal, the first drain terminal, and the (n−2)th signal input terminal; the nineteenth drain terminal is electrically connected to the sixteenth source terminal, the seventeenth drain terminal, and the eighteenth drain terminal; the nineteenth source terminal is electrically connected to the low level input terminal.

The nth stage gate driver unit further comprises a (n−1)th stage signal input terminal and a third output terminal and when the nth stage gate driver unit is one of the second stage to the last stage gate driver unit, the (n−1)th stage signal input terminal of the nth stage gate driver unit is electrically connected to the third output terminal of the (n−1)th stage gate driver unit; when the nth stage gate driver unit is the first stage gate driver unit, the nth stage gate driver unit does not comprise the (n−1)th stage signal input terminal; when the nth stage gate driver unit is one of the first stage to the second last stage gate driver unit, the third output terminal of the nth stage gate driver unit is electrically connected to the (n−1)th stage signal input terminal of the (n−1)th stage gate driver unit; and when the nth stage gate driver unit is the last stage gate driver unit, the third output terminal of the nth stage gate driver unit is floating;

the pull-down unit comprises a first pull-down unit, a second pull-down unit, and a second pull-down signal generation unit, wherein the first pull-down unit is electrically connected to the driving unit, the (n−1)th stage signal input terminal, and the low level input terminal; the second pull-down unit is electrically connected to the driving unit, the second pull-down signal generation unit, the first pull-down unit, and the low level input terminal; the second pull-down signal generation unit is electrically connected to the driving unit, the second pull-down unit, the low-frequency clock signal first input terminal, the low-frequency clock signal second input terminal, and the low level input terminal;

the first pull-down unit comprises a fourth TFT and a fifth TFT, wherein the fourth TFT comprises a fourth gate terminal, a fourth source terminal, and a fourth drain terminal and the fifth TFT comprises a fifth gate terminal, a fifth source terminal, and a fifth drain terminal; the fourth gate terminal and the fifth gate terminal are electrically connected to the (n−1)th stage signal input terminal; the fourth drain terminal is electrically connected to the first source terminal, one end of the capacitor, the second gate terminal, the third drain terminal, the second output terminal, the second pull-down signal generation unit, and the second pull-down unit; the fourth source terminal and the fifth source terminal are electrically connected to the low level input terminal; the fifth drain terminal is electrically connected to the second source terminal, an opposite end of the capacitor, the first output terminal, and the second pull-down unit;

the second pull-down unit comprises a sixth TFT and a seventh TFTT7, wherein the sixth TFT comprises a sixth gate terminal, a sixth source terminal, and a sixth drain terminal and the seventh TFT comprises a seventh gate terminal, a seventh source terminal, and a seventh drain terminal; the sixth gate terminal is electrically connected to the second pull-down signal generation unit, the seventh gate terminal, and the third output terminal; the sixth drain terminal is electrically connected to the first source terminal, the one end of the capacitor, the second gate terminal, the third drain terminal, the fourth drain terminal, the second output terminal, and the second pull-down signal generation unit; the sixth source terminal and the seventh source terminal are electrically connected to the low level input terminal; the seventh drain terminal is electrically connected to the second source terminal, the opposite end of the capacitor, the first output terminal, and the fifth drain terminal; and the second pull-down signal generation unit comprises a fourteenth thin-film transistor, a fifteenth thin-film transistor, a sixteenth thin-film transistor, a seventeenth thin-film transistor, and an eighteenth thin-film transistor, wherein the fourteenth thin-film transistor comprises a fourteenth gate terminal, a fourteenth source terminal, and a fourteenth drain terminal; the fifteenth thin-film transistor comprises a fifteenth gate terminal, a fifteenth source terminal, and a fifteenth drain terminal; the sixteenth thin-film transistor comprises a sixteenth gate terminal, a sixteenth source terminal, and a sixteenth drain terminal; the seventeenth thin-film transistor comprises a seventeenth gate terminal, a seventeenth source terminal, and a seventeenth drain terminal; the eighteenth thin-film transistor comprises an eighteenth gate terminal, an eighteenth source terminal, and an eighteenth drain terminal; the fourteenth gate terminal, the fourteenth drain terminal, the fifteenth drain terminal, and the sixteenth gate terminal are electrically connected to the low-frequency clock signal first input terminal; the fourteenth source terminal is electrically connected to the fifteenth source terminal, the sixteenth drain terminal, the sixth gate terminal, the seventh gate terminal, and the third output terminal; the sixteenth source terminal is electrically connected to the seventeenth drain terminal and the eighteenth drain terminal; the seventeenth gate terminal is electrically connected to the first source terminal, the one end of the capacitor, the second gate terminal, the third drain terminal, the fourth drain terminal, and the sixth drain terminal; the seventeenth source terminal and the eighteenth source terminal are electrically connected to the low level input terminal; the eighteenth gate terminal is electrically connected to the (n+1)th signal input terminal.

The fifteenth gate terminal is electrically connected to the low-frequency clock signal second input terminal.

The fifteenth gate terminal is electrically connected to the fourteenth source terminal, the fifteenth source terminal, the sixteenth drain terminal, the sixth gate terminal, the seventh gate terminal, and the third output terminal.

The second pull-down signal generation unit further comprises a nineteenth thin-film transistor, wherein the nineteenth thin-film transistor comprises a nineteenth gate terminal, a nineteenth source terminal, and a nineteenth drain terminal; the nineteenth gate terminal is electrically connected to the first gate terminal, the first drain terminal, and the (n−2)th signal input terminal; the nineteenth drain terminal is electrically connected to the sixteenth source terminal, the seventeenth drain terminal, and the eighteenth drain terminal; and the nineteenth drain terminal is electrically connected to the low level input terminal.

The supplementary pull-down unit comprises a first supplementary pull-down unit, a first supplementary pull-down signal generation unit, a second supplementary pull-down unit, and a second supplementary pull-down signal generation unit, wherein the first supplementary pull-down unit is electrically connected to the supplementary driving unit, the first supplementary pull-down signal generation unit, the second supplementary pull-down unit, and the low level input terminal; the first supplementary pull-down signal generation unit is electrically connected to the first supplementary pull-down unit, the low-frequency clock signal first input terminal, the low-frequency clock signal second input terminal, and the low level input terminal; the second supplementary pull-down unit is electrically connected to the supplementary driving unit, the second supplementary pull-down signal generation unit, the first supplementary pull-down unit, and the low level input terminal; the second supplementary pull-down signal generation unit is electrically connected to the second supplementary pull-down unit, the low-frequency clock signal first input terminal, the low-frequency clock signal second input terminal, and the low level input terminal.

The first supplementary pull-down unit comprises a twenty-fourth thin-film transistor and a twenty-fifth thin-film transistor, wherein the twenty-fourth thin-film transistor comprises a twenty-fourth gate terminal, a twenty-fourth source terminal, and a twenty-fourth drain terminal and the twenty-fifth thin-film transistor comprises a twenty-fifth gate terminal, a twenty-fifth source terminal, and a twenty-fifth drain terminal; the twenty-fourth gate terminal is electrically connected to the first supplementary pull-down signal generation unit and the twenty-fifth gate terminal; the twenty-fourth drain terminal is electrically connected to the twenty-first source terminal, the twenty-second source terminal, the one end of the supplementary capacitor, the twenty-third gate terminal, the second supplementary output terminal, the second supplementary pull-down signal generation unit, and the second supplementary pull-down unit; the twenty-fifth drain terminal is electrically connected to the opposite end of the supplementary capacitor, the first supplementary output terminal, and the second supplementary pull-down unit; the twenty-fifth source terminal is electrically connected to the low level input terminal; and the second supplementary pull-down unit comprises a twenty-sixth thin-film transistor and a twenty-seventh thin-film transistor, wherein the twenty-sixth thin-film transistor comprises a twenty-sixth gate terminal, a twenty-sixth source terminal, and a twenty-sixth drain terminal and the twenty-seventh thin-film transistor comprises a twenty-seventh gate terminal, a twenty-seventh source terminal, and a twenty-seventh drain terminal; the twenty-sixth gate terminal is electrically connected to the second supplementary pull-down signal generation unit and the twenty-seventh gate terminal; the twenty-sixth drain terminal is electrically connected to the twenty-fourth source terminal, the twenty-first source terminal, the twenty-second source terminal, the one end of the supplementary capacitor, the twenty-third gate terminal, the second supplementary output terminal, and the second supplementary pull-down signal generation unit; the twenty-seventh drain terminal is electrically connected to the opposite end of the supplementary capacitor, the first supplementary output terminal, the twenty-fifth drain terminal, and the twenty-third source terminal; the twenty-seventh source terminal is electrically connected to the low level input terminal.

The twenty-fourth source terminal is electrically connected to the low level input terminal; and the twenty-sixth source terminal is electrically connected to the low level input terminal.

The twenty-fourth source terminal is electrically connected to the twenty-fifth drain terminal, the opposite end of the supplementary capacitor, the first supplementary output terminal, and the second supplementary pull-down unit; and the twenty-sixth source terminal is electrically connected to the twenty-seventh drain terminal, the opposite end of the supplementary capacitor, the first supplementary output terminal, the twenty-fifth drain terminal, and the twenty-third source terminal.

The first supplementary pull-down signal generation unit comprises a twenty-eighth thin-film transistor, a twenty-ninth thin-film transistor, a thirtieth thin-film transistor, and a thirty-first thin-film transistor, wherein the twenty-eighth thin-film transistor comprises a twenty-eighth gate terminal, a twenty-eighth source terminal, and a twenty-eighth drain terminal; the twenty-ninth thin-film transistor a the twenty-ninth gate terminal, a twenty-ninth source terminal, and a twenty-ninth drain terminal; the thirtieth thin-film transistor comprises a thirtieth gate terminal, a thirtieth source terminal, and a thirtieth drain terminal; the thirty-first thin-film transistor comprises a thirty-first gate terminal, a thirty-first source terminal, and a thirty-first drain terminal; the twenty-eighth gate terminal, the twenty-eighth drain terminal, the twenty-ninth drain terminal and the thirtieth gate terminal are electrically connected to the low-frequency clock signal second input terminal; the twenty-eighth source terminal is electrically connected to the twenty-ninth source terminal, the thirtieth drain terminal, the twenty-fourth gate terminal, and the twenty-fifth gate terminal; the thirtieth source terminal is electrically connected to the thirty-first drain terminal; the thirty-first gate terminal is electrically connected to the twenty-first source terminal, the twenty-second source terminal, the one end of the supplementary capacitor, the twenty-third gate terminal, the second supplementary output terminal, the twenty-sixth drain terminal, and the twenty-fourth drain terminal electrically connected; the thirty-first source terminal is electrically connected to the low level input terminal; and the second supplementary pull-down signal generation unit comprises a thirty-second thin-film transistor, a thirty-third thin-film transistor, a thirty-fourth thin-film transistor, and a thirty-fifth thin-film transistor, wherein the thirty-second thin-film transistor comprises a thirty-second gate terminal, a thirty-second source terminal, and a thirty-second drain terminal; the thirty-third thin-film transistor comprises a thirty-third gate terminal, a thirty-third source terminal, and a thirty-third drain terminal; the thirty-fourth thin-film transistor comprises a thirty-fourth gate terminal, a thirty-fourth source terminal, and a thirty-fourth drain terminal; the thirty-fifth thin-film transistor comprises a thirty-fifth gate terminal, a thirty-fifth source terminal, and a thirty-fifth drain terminal; the thirty-second gate terminal, the thirty-second drain terminal, the thirty-third drain terminal, and the thirty-fourth gate terminal are electrically connected to the low-frequency clock signal first input terminal; the thirty-second source terminal is electrically connected to the thirty-third source terminal, the thirty-fourth drain terminal, the twenty-sixth gate terminal, and the twenty-seventh gate terminal; the thirty-fourth source terminal is electrically connected to the thirty-fifth drain terminal; the thirty-fifth gate terminal is electrically connected to the thirty-first gate terminal, the twenty-first source terminal, the twenty-second source terminal, the one end of the supplementary capacitor, the twenty-third gate terminal, the second supplementary output terminal, the twenty-sixth drain terminal, and the twenty-fourth drain terminal; the thirty-fifth source terminal is electrically connected to the low level input terminal.

The twenty-ninth gate terminal is electrically connected to the low-frequency clock signal first input terminal; and the thirty-third gate terminal is electrically connected to the low-frequency clock signal second input terminal.

The twenty-ninth gate terminal is electrically connected to the twenty-eighth source terminal, the twenty-ninth source terminal, the thirtieth drain terminal, the twenty-fourth gate terminal, and the twenty-fifth gate terminal; the thirty-third gate terminal is electrically connected to the thirty-second source terminal, the thirty-third source terminal, the thirty-fourth drain terminal, the twenty-sixth gate terminal, and the twenty-seventh gate terminal.

The present invention also provides a display panel with a GOA circuit, which comprises a data driver circuit and a display panel body. The display panel body comprising the above described GOA circuit and a display panel pixel zone. The display panel pixel zone comprises a plurality of pixel units arranged in an array.

The efficacy of the present invention is that the present invention provides a GOA circuit and a display panel with the GOA circuit. The circuit adopts a dual-pull-down architecture so that thin-film transistors contained in pull-down units and supplementary pull-down units of the circuit can be set in an operation environment featuring dual polarity electrical biasing to effectively suppress threshold voltage drifting of the thin-film transistors of the pull-down units and the supplementary pull-down units and extend the lifespan of circuit thereby making the circuit better meet the needs of large- and medium-sized display panels. Further, the circuit has a simple structure and reduced power consumption and is also fit to low temperature and high temperature operations.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, of the present invention will be apparent from the following detailed description of an embodiment of the present invention, with reference to the attached drawings. In the drawings.

DETAILED DESCRIPTION OF THE PREFERRED EMBODIMENTS

Figure 1:
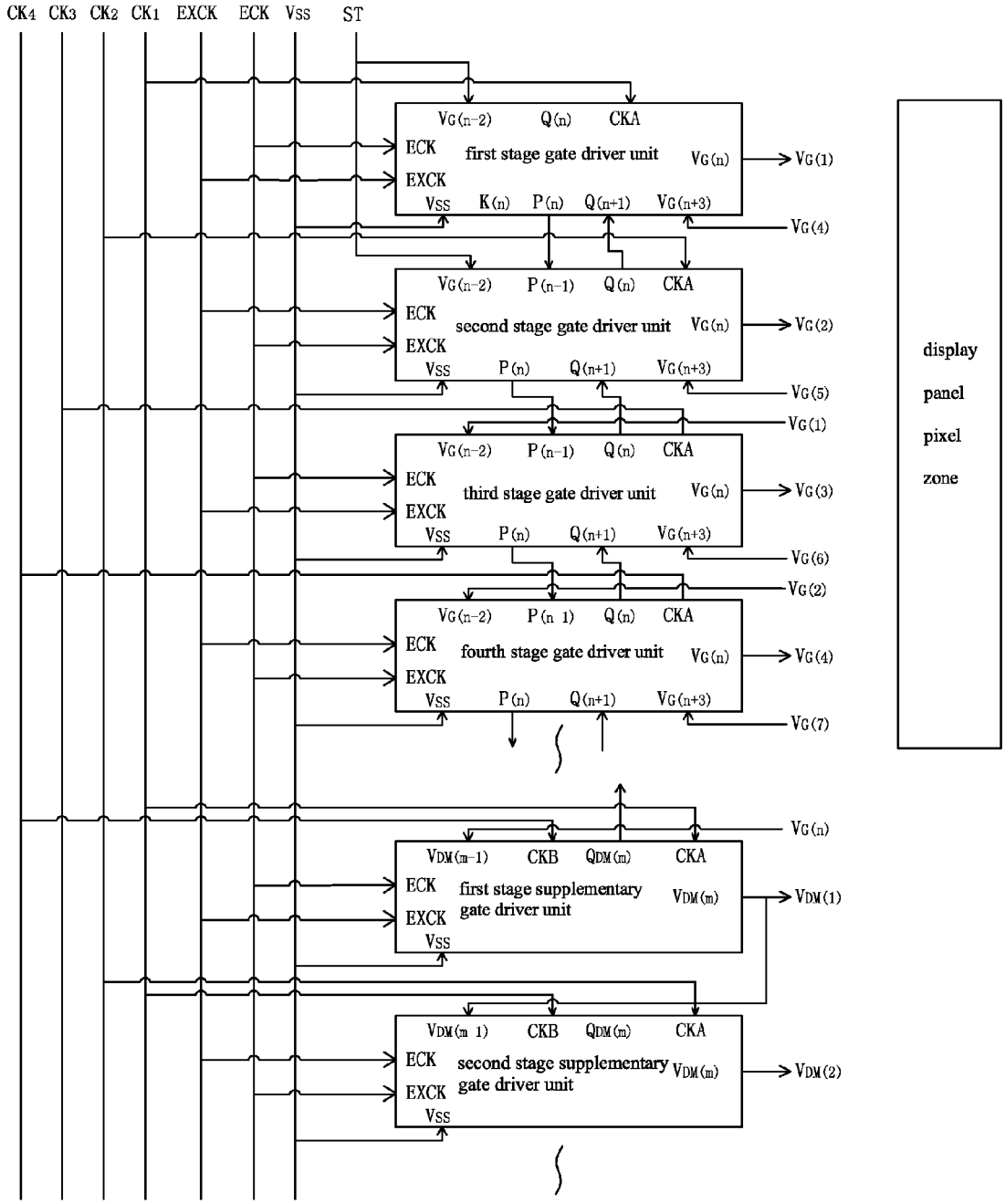
FIG. 1 is a schematic view showing a gate driver on array (GOA) circuit according to the present invention.

To further expound the technical solution adopted in the present invention and the advantages thereof, a detailed description is given to a preferred embodiment of the present invention and the attached drawings.

Figure 2A:
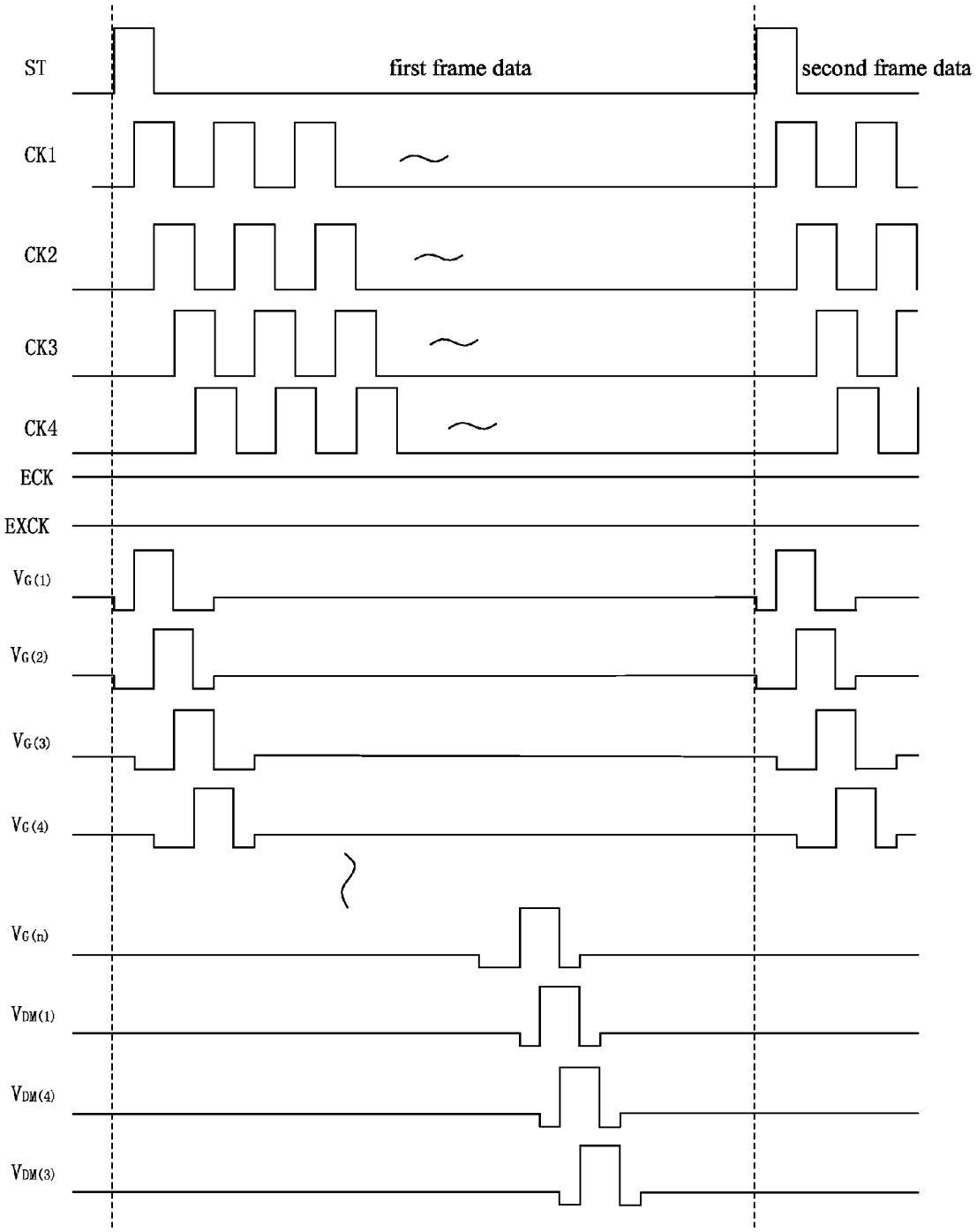
FIG. 2A is a timing diagram of the GOA circuit according to the present invention.
Figure 2B:
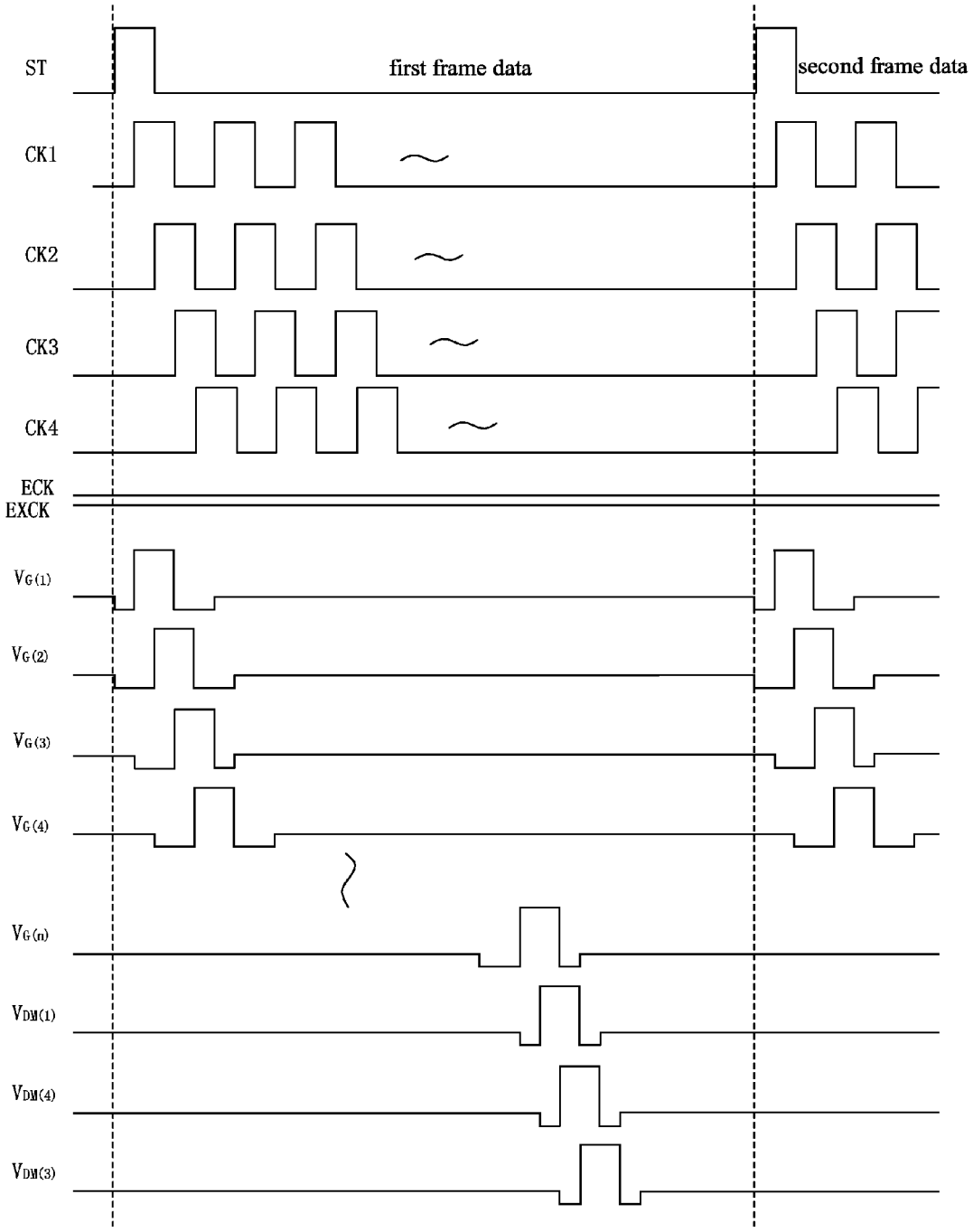
FIG. 2B is another timing diagram of the GOA circuit according to the present invention.

Referring to FIGS. 1-4, the present invention provides a gate driver on array (GOA) circuit, comprises multiple stages of gate driver units and multiple stages of supplementary gate driver units connected in cascade, wherein:

a nth stage gate driver unit comprises a (n−2)th signal input terminal 21, a (n+1)th signal input terminal 22, a (n+3)th signal input terminal 23, a high-frequency clock signal first input terminal 24, a low-frequency clock signal first input terminal 25, a low-frequency clock signal second input terminal 26, a low level input terminal 27, a first output terminal 28, and a second output terminal 29, wherein the first output terminal 28 of the nth stage GOA circuit unit functions to drive a pixel zone of a display panel;

a mth stage supplementary gate driver unit comprises a (m−1)th supplementary signal input terminal 35, a high-frequency clock signal first input terminal 24, a high-frequency clock signal second input terminal 34, a low-frequency clock signal first input terminal 25, a low-frequency clock signal second input terminal 26, a low level input terminal 27, a first supplementary output terminal 38, and a second supplementary output terminal 39;

when the nth stage gate driver unit is any one gate driver unit of the fourth stage to the fourth last stage gate driver unit, the (n−2)th signal input terminal 21 of the nth stage gate driver unit is electrically connected to the first output terminal 28 of the (n−2)th stage gate driver unit; the (n+1)th signal input terminal 22 of the nth stage gate driver unit is electrically connected to the second output terminal 29 of the (n+1) th stage gate driver unit; the (n+3)th signal input terminal 23 of the nth stage gate driver unit is electrically connected to the first output terminal 28 of the (n+3)th stage gate driver unit; the first output terminal 28 of the nth stage gate driver unit is electrically connected to the (n−2)th signal input terminal 21 of the (n+2)th stage gate driver unit and the (n+3)th signal input terminal 23 of the (n−3)th stage gate driver unit; and the second output terminal 29 of the nth stage gate driver unit is electrically connected to the (n+1)th signal input terminal 22 of the (n−1)th stage gate driver unit;

when the nth stage gate driver unit is the first stage gate driver unit, the (n−2)th signal input terminal 21 of the nth stage gate driver unit functions to receive an input of a pulse excitation signal; the (n+1)th signal input terminal 22 of the nth stage gate driver unit is electrically connected to the second output terminal 29 of the (n+1)th stage gate driver unit; the (n+3)th signal input terminal 23 of the nth stage gate driver unit is electrically connected to the first output terminal 28 of the (n+3)th stage gate driver unit; the first output terminal 28 of the nth stage gate driver unit is electrically connected to the (n−2)th signal input terminal 21 of the (n+2)th stage gate driver unit; and the second output terminal 29 of the nth stage gate driver unit is floating;

when the nth stage gate driver unit is the second stage gate driver unit, the (n−2)th signal input terminal 21 of the nth stage gate driver unit functions to receive an input of a pulse excitation signal; the (n+1)th signal input terminal 22 of the nth stage gate driver unit is electrically connected to the second output terminal 29 of the (n+1)th stage gate driver unit; the (n+3)th signal input terminal 23 of the nth stage gate driver unit is electrically connected to the first output terminal 28 of the (n+3)th stage gate driver unit; the first output terminal 28 of the nth stage gate driver unit is electrically connected to the (n−2)th signal input terminal 21 of the (n+2)th stage gate driver unit; and the second output terminal 29 of the nth stage gate driver unit is electrically connected to the (n+1)th signal input terminal 22 of the (n−1)th stage gate driver unit;

when the nth stage gate driver unit is the third stage gate driver uni, the (n−2)th signal input terminal 21 of the nth stage gate driver unit is electrically connected to the first output terminal 28 of the (n−2)th stage gate driver unit; the (n−1)th signal input terminal 22 of the nth stage gate driver unit is electrically connected to the second output terminal 29 of the (n+1)th stage gate driver unit; the (n+3)th signal input terminal 23 of the nth stage gate driver unit is electrically connected to the first output terminal 28 of the (n+3)th stage gate driver unit; the first output terminal 28 of the nth stage gate driver unit is electrically connected to the (n−2)th signal input terminal 21 of the (n+2)th stage gate driver unit; and the second output terminal 29 of the nth stage gate driver unit is electrically connected to the (n+1)th signal input terminal 22 of the (n−1)th stage gate driver unit;

when the nth stage gate driver unit is the third last stage gate driver unit, the (n−2)th signal input terminal 21 of the nth stage gate driver unit is electrically connected to the first output terminal 28 of the (n−2)th stage gate driver unit; the (n+1)th signal input terminal 22 of the nth stage gate driver unit is electrically connected to the second output terminal 29 of the (n+1)th stage gate driver unit; the (n+3)th signal input terminal 23 of the nth stage gate driver unit is electrically connected to the first supplementary output terminal 38 of the first stage supplementary gate driver unit; the first output terminal 28 of the nth stage gate driver unit is electrically connected to the (n−2)th signal input terminal 21 of the (n+2)th stage gate driver unit and the (n+3)th signal input terminal 23 of the (n−3)th stage gate driver unit; and the second output terminal 29 of the nth stage gate driver unit is electrically connected to the (n+1)th signal input terminal 22 of the (n−1)th stage gate driver unit;

when the nth stage gate driver unit is the second last stage gate driver unit, the (n−2)th signal input terminal 21 of the nth stage gate driver unit is electrically connected to the first output terminal 28 of the (n−2)th stage gate driver unit; the (n−1)th signal input terminal 22 of the nth stage gate driver unit is electrically connected to the second output terminal 29 of the (n+1)th stage gate driver unit; the (n+3)th signal input terminal 23 of the nth stage gate driver unit is electrically connected to the first supplementary output terminal 38 of the second stage supplementary gate driver unit; the first output terminal 28 of the nth stage gate driver unit is electrically connected to the (n+3)th signal input terminal 23 of the (n−3)th stage gate driver unit; and the second output terminal 29 of the nth stage gate driver unit is electrically connected to the (n+1)th signal input terminal 22 of the (n−1)th stage gate driver unit;

when the nth stage gate driver unit is the last stage gate driver unit, the (n−2)th signal input terminal 21 of the nth stage gate driver unit is electrically connected to the first output terminal 28 of the (n−2)th stage gate driver unit; the (n+1)th signal input terminal 22 of the nth stage gate driver unit is electrically connected to the second supplementary output terminal 39 of the first stage supplementary gate driver unit; the (n+3)th signal input terminal 23 of the nth stage gate driver unit is electrically connected to the first supplementary output terminal 38 of the third stage supplementary gate driver unit; the first output terminal 28 of the nth stage gate driver unit is electrically connected the (n+3)th signal input terminal 23 of the (n−3)th stage gate driver unit and the (m−1)th supplementary signal input terminal 35 of the first stage supplementary gate driver unit; and the second output terminal 29 of the nth stage gate driver unit is electrically connected to the (n+1)th signal input terminal 22 of the (n−1)th stage gate driver unit;

when the mth stage supplementary gate driver unit is any one supplementary gate driver unit of the fourth stage to the last stage supplementary gate driver unit, the (m−1)th supplementary signal input terminal 35 of the mth stage supplementary gate driver unit is electrically connected to the first supplementary output terminal 38 of the (m−1)th stage supplementary gate driver unit; the first supplementary output terminal 38 of the mth stage supplementary gate driver unit is electrically connected to the (m−1)th supplementary signal input terminal 35 of the (m+1)th stage supplementary gate driver unit; and the second supplementary output terminal 39 is floating;

when the mth stage supplementary gate driver unit is the first stage supplementary gate driver unit, the (m−1)th supplementary signal input terminal 35 of the mth stage supplementary gate driver unit is electrically connected to the first output terminal 28 of the last stage gate driver unit; the first supplementary output terminal 38 of the mth stage supplementary gate driver unit is electrically connected to the (m−1)th supplementary signal input terminal 35 of the (m+1)th stage supplementary gate driver unit and the (n+3)th signal input terminal 23 of the third last stage gate driver unit; and the second supplementary output terminal 39 is electrically connected to the (n+1)th signal input terminal 22 of the last stage gate driver unit;

when the mth stage supplementary gate driver unit is the second stage supplementary gate driver unit, the (m−1)th supplementary signal input terminal 35 of the mth stage supplementary gate driver unit is electrically connected to the first supplementary output terminal 38 of the (m−1)th stage supplementary gate driver unit; the first supplementary output terminal 38 of the mth stage supplementary gate driver unit is electrically connected to the (m−1)th supplementary signal input terminal 35 of the (m+1)th stage supplementary gate driver unit and the (n+3)th signal input terminal 23 of the second last stage gate driver unit; and the second supplementary output terminal 39 is floating;

when the mth stage supplementary gate driver unit is the third stage supplementary gate driver unit, the (m−1)th supplementary signal input terminal 35 of the mth stage supplementary gate driver unit is electrically connected to the first supplementary output terminal 38 of the (m−1)th stage supplementary gate driver unit; the first supplementary output terminal 38 of the mth stage supplementary gate driver unit is electrically connected to the (m−1)th supplementary signal input terminal 35 of the (m+1)th stage supplementary gate driver unit and the (n+3)th signal input terminal 23 of the last stage gate driver unit; and the second supplementary output terminal 39 is floating;

the nth stage gate driver unit of the GOA circuit further comprises:

a driving unit 42, which is electrically connected to the (n−2)th signal input terminal 21, the high-frequency clock signal first input terminal 24, the (n+3)th signal input terminal 23, the first output terminal 28, and the second output terminal 29; and a pull-down unit 44, which is electrically connected to the (n+1)th signal input terminal 22, the low-frequency clock signal first input terminal 25, the low-frequency clock signal second input terminal 26, the low level input terminal 27, and the driving unit 42.

the mth stage supplementary gate driver unit of the GOA circuit further comprises:

a supplementary driving unit 52, which is electrically connected to the (m−1)th supplementary signal input terminal 31, the high-frequency clock signal first input terminal 24, the high-frequency clock signal second input terminal 25, the first supplementary output terminal 38, and the second supplementary output terminal 39; and a supplementary pull-down unit 54, which is electrically connected to the low-frequency clock signal first input terminal 25, the low-frequency clock signal second input terminal 26, the low level input terminal 27, and the supplementary driving unit 52. The low level input terminal 27 receives an input signal that is a low level signal $V_{ss}$; the high-frequency clock signal first input terminal 24 and the high-frequency clock signal second input terminal 34 receive an input signal that is a first high-frequency clock signal $CK_1$, a second high-frequency clock signal $CK_2$, a third high-frequency clock signal $CK_3$, or a fourth high-frequency clock signal $CK_4$, in which the first high-frequency clock signal $CK_1$ and the third high-frequency clock signal $CK_2$ are of opposite phases, the second high-frequency clock signal $CK_2$ and the fourth high-frequency clock signal are of opposite phases, and the first high-frequency clock signal and the third high-frequency clock signal are of waveforms that are identical in shape to but different in initial phase from those of the second high-frequency clock signal and the fourth high-frequency clock signal (as shown in FIGS. 2A and 2B); when the input signal of the high-frequency clock signal first input terminal 24 of the nth stage gate driver unit of the GOA circuit is the first high-frequency clock signal, the input signals of the high-frequency clock signal first input terminals 24 of the (n+1)th stage, the (n+2)th stage, and the (n+3)th stage gate driver units are respectively the second, the third, and the fourth high-frequency clock signals; when the input signals of the high-frequency clock signal first input terminal 24 and the high-frequency clock signal second input terminal 34 of the mth stage supplementary gate driver unit of the GOA circuit are respectively the kth and the (k−1)th clock signals, the input signals of the high-frequency clock signal first input terminal 24 and the high-frequency clock signal second input terminal 34 of the (m+1)th stage supplementary gate driver unit of the GOA circuit are respectively the (k+1)th and the kth clock signals, wherein the value of k is from 1 to 4 and when k is 1, the value of k−1 is set to 4, and when k is 4, the value of k−1 is set to 1.

The low-frequency clock signal first input terminal 25 and the low-frequency clock signal second input terminal 26 receive an input signal that is a first low-frequency clock signal ECK or a second low-frequency clock signal EXCK, wherein the first low-frequency clock signal and the second low-frequency clock signal are of opposite voltages, namely when the first low-frequency clock signal is a high level signal, the second low-frequency clock signal is a low level signal and when the first low-frequency clock signal is a low level signal, the second low-frequency clock signal is a high level signal; when the input signals of the low-frequency clock signal first input terminal 25 and the low-frequency clock signal second input terminal 26 of the nth stage gate driver unit of the GOA circuit are respectively the first low-frequency clock signal and the second low-frequency clock signal, the input signals of the low-frequency clock signal first input terminal 25 and the low-frequency clock signal second input terminal 26 of the (n+1)th stage gate driver unit are respectively the second low-frequency clock signal and the first low-frequency clock signal; when the input signals of the low-frequency clock signal first input terminal 25 and the low-frequency clock signal second input terminal 26 of the mth stage supplementary gate driver unit of the GOA circuit are respectively the first low-frequency clock signal and the second low-frequency clock signal, the input signals of the low-frequency clock signal first input terminal 25 and the low-frequency clock signal second input terminal 26 of the (m+1)th stage supplementary gate driver unit are respectively the second low-frequency clock signal and the first low-frequency clock signal.

Figure 3:
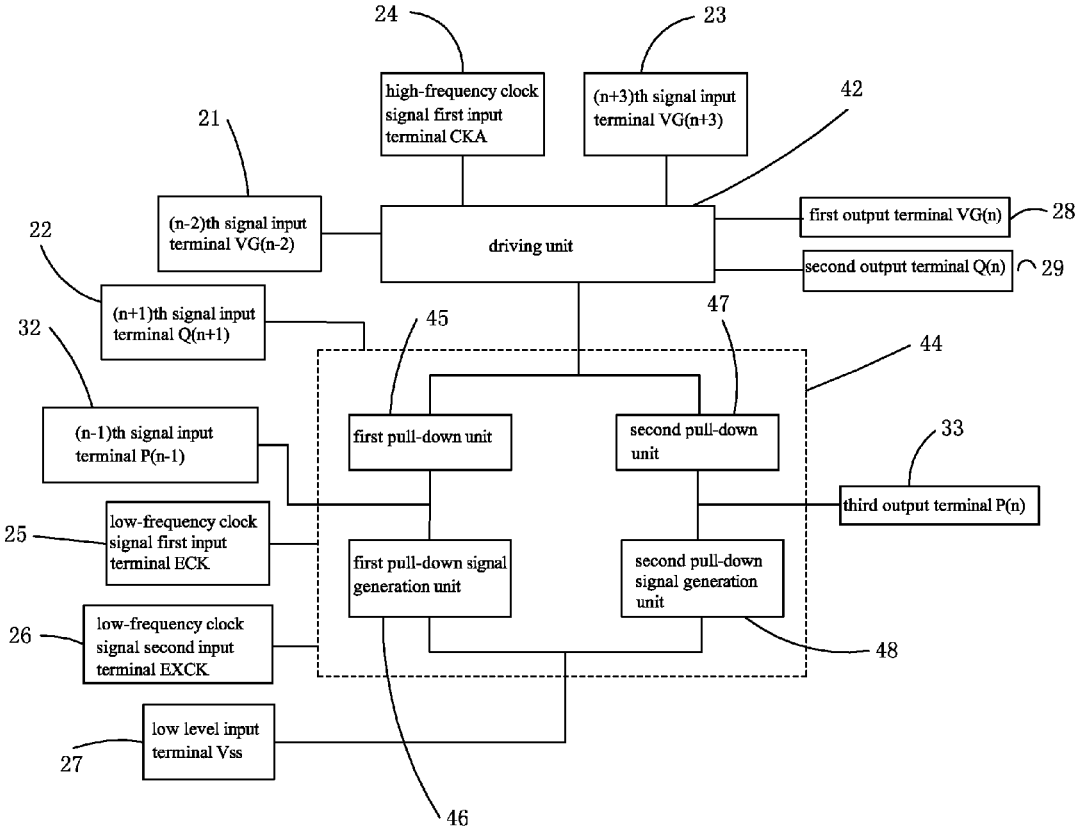
FIG. 3 is a schematic view showing a gate driver unit of the GOA according to the present invention.
Figure 4:
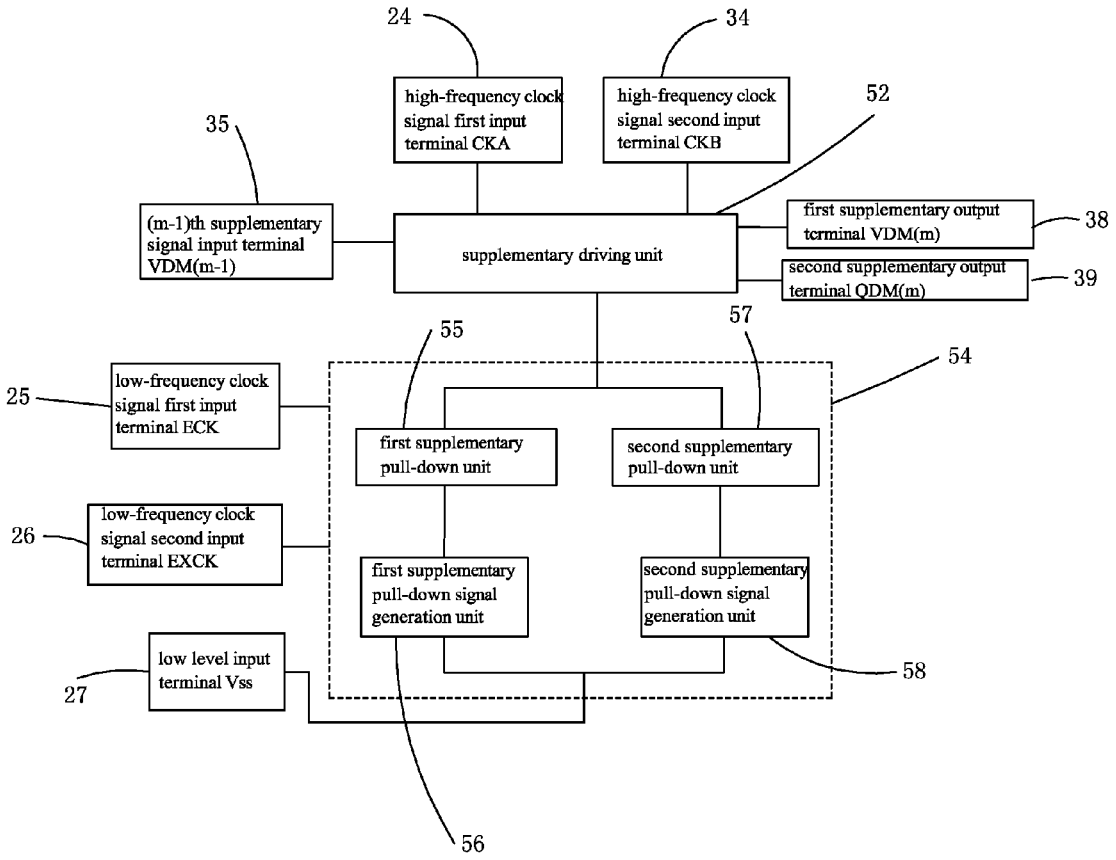
FIG. 4 is a schematic view showing a supplementary gate driver unit of the GOA according to the present invention.
Figure 5:
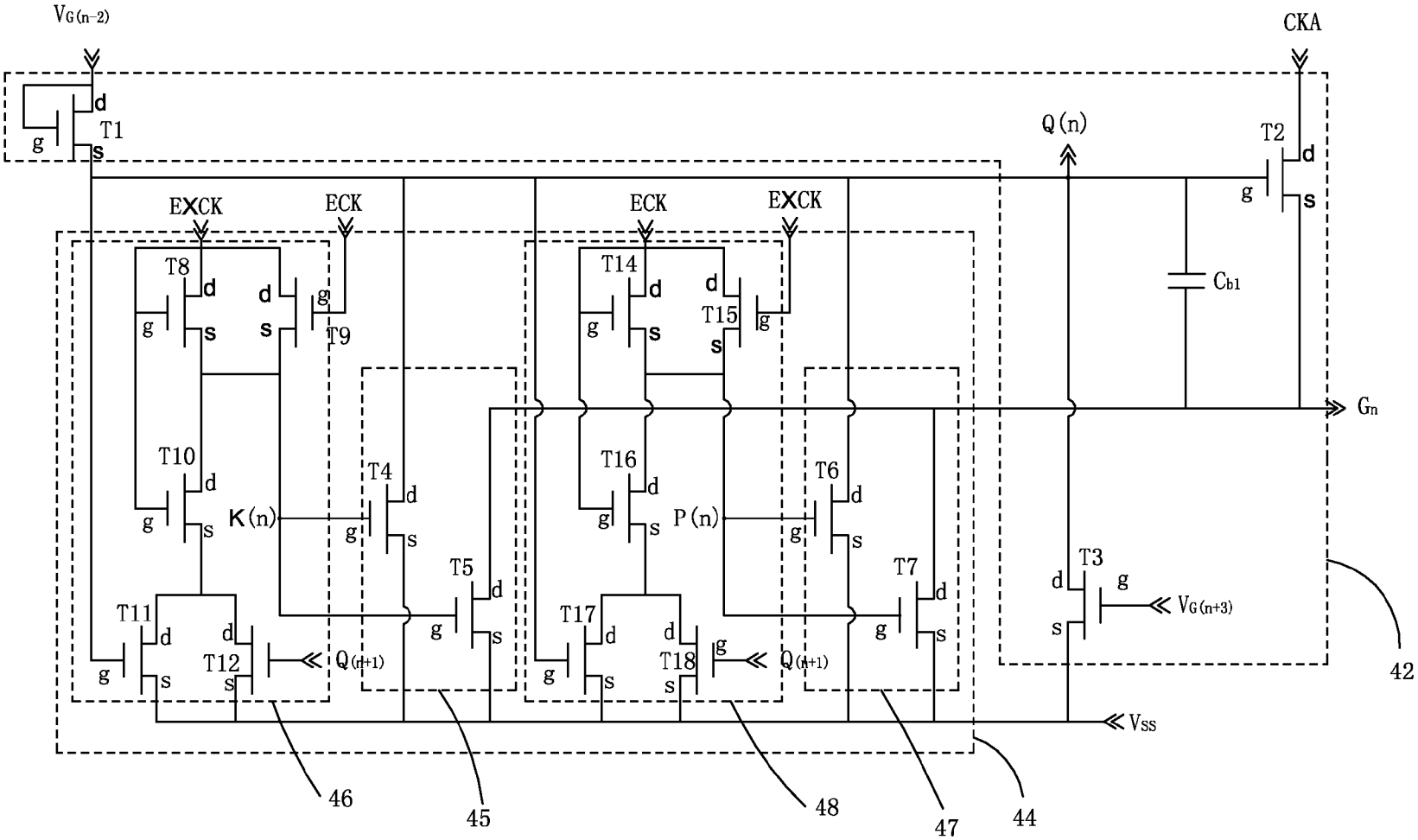
FIG. 5 is a circuit diagram of a first embodiment of the gate driver unit according to the present invention.

Referring to FIGS. 5-8, a first embodiment of the gate driver unit according to the present invention is shown, additional reference being had to FIGS. 1-3, wherein:

the driving unit 42 comprises a capacitor $C_{b1}$, a first TFT (Thin-Film Transistor) T1, a second TFT T2, and a third TFT T3; the first TFT T1 comprises a first gate terminal, a first source terminal, and a first drain terminal; the second TFT T2 comprises a second gate terminal, a second source terminal, and a second drain terminal; the third TFT T3 comprises a third gate terminal, a third source terminal, and a third drain terminal; the first gate terminal and the first drain terminal are electrically connected to the (n−2)th signal input terminal; the first source terminal is electrically connected to one end of the capacitor $C_{b1}$, the second gate terminal, the third drain terminal, the second output terminal 29, and the pull-down unit 44; the second drain terminal is electrically connected to the high-frequency clock signal first input terminal 24; the second source terminal is electrically connected to an opposite end of the capacitor $C_{b1}$, the first output terminal 28, and the pull-down unit 44; the third gate terminal is electrically connected to the (n+3)th signal input terminal 23; the third source terminal is electrically connected to the low level input terminal 27;

the pull-down unit 44 comprises a first pull-down unit 45, a first pull-down signal generation unit 46, a second pull-down unit 47, and a second pull-down signal generation unit 48, wherein the first pull-down unit 45 is electrically connected to the driving unit 42, the first pull-down signal generation unit 46, the second pull-down unit 47, and the low level input terminal 27; the first pull-down signal generation unit 46 is electrically connected to the first pull-down unit 45, the low-frequency clock signal first input terminal 25, the low-frequency clock signal second input terminal 26, and the low level input terminal 27; the second pull-down unit 47 is electrically connected to the driving unit 42, the second pull-down signal generation unit 48, the first pull-down unit 45, and the low level input terminal 27; and the second pull-down signal generation unit 48 is electrically connected to the second pull-down unit 47, the low-frequency clock signal first input terminal 25, the low-frequency clock signal second input terminal 26, and the low level input terminal 27;

the first pull-down unit 45 comprises a fourth TFT T4 and a fifth TFT T5, wherein the fourth TFT T4 comprises a fourth gate terminal, a fourth source terminal, and a fourth drain terminal; the fifth TFT T5 comprises a fifth gate terminal, a fifth source terminal, and a fifth drain terminal; the fourth gate terminal and the fifth gate terminal are electrically connected to the first pull-down signal generation unit 46; the fourth drain terminal is electrically connected to the first source terminal, the one end of the capacitor $C_{b1}$, the second gate terminal, the third drain terminal, the second output terminal 29, the second pull-down signal generation unit 48, and the second pull-down unit 47; the fourth source terminal and the fifth source terminal are electrically connected to the low level input terminal 27; the fifth drain terminal is electrically connected to the second source terminal, the opposite end of the capacitor, the first output terminal 28, and the second pull-down unit 47;

the second pull-down unit 47 comprises a sixth TFT T6 and a seventh TFT T7, wherein the sixth TFT T6 comprises a sixth gate terminal, a sixth source terminal, and a sixth drain terminal and the seventh TFT T7 comprises a seventh gate terminal, a seventh source terminal, and a seventh drain terminal; the sixth gate terminal and the seventh gate terminal are electrically connected to the second pull-down signal generation unit 48; the sixth source terminal and the seventh source terminal are electrically connected to the low level input terminal 27; the sixth drain terminal is electrically connected to the first source terminal, the one end of the capacitor, the second gate terminal, the third drain terminal, the fourth drain terminal, the second output terminal 29, and the second pull-down signal generation unit 48; the seventh source terminal is electrically connected to the second source terminal, the opposite end of the capacitor, the first output terminal 28, and the fifth drain terminal;

the first pull-down signal generation unit 46 comprises an eighth TFT T8, a ninth TFT T9, a tenth TFT T10, an eleventh TFT T11, and a twelfth TFT T12, wherein the eighth TFT T8 comprises an eighth gate terminal, an eighth source terminal, and an eighth drain terminal; the ninth TFT T9 comprises a ninth gate terminal, a ninth source terminal, and a ninth drain terminal; the ninth gate terminal is electrically connected to the low-frequency clock signal first input terminal 25; the tenth TFT T10 comprises a tenth gate terminal, a tenth source terminal, and a tenth drain terminal; the eleventh TFT T11 comprises an eleventh gate terminal, an eleventh source terminal, and an eleventh drain terminal; the twelfth TFT T12 comprises a twelfth gate terminal, a twelfth source terminal, and a twelfth drain terminal; the eighth gate terminal, the eighth drain terminal, the ninth drain terminal, and the tenth gate terminal are electrically connected to the low-frequency clock signal second input terminal 26; the eighth source terminal is electrically connected to the ninth source terminal, the tenth drain terminal, the fourth gate terminal, and the fifth gate terminal; the tenth source terminal is electrically connected to the eleventh drain terminal and the twelfth drain terminal; the eleventh gate terminal is electrically connected to the first source terminal, the one end of the capacitor $C_{b1}$, the second gate terminal, the third drain terminal, the fourth drain terminal, the sixth drain terminal, and the second output terminal 29; the eleventh source terminal and the twelfth source terminal are electrically connected to the low level input terminal 27; the twelfth gate terminal is electrically connected to the (n+1)th signal input terminal;

the second pull-down signal generation unit 48 comprises a fourteenth thin-film transistor T14, a fifteenth thin-film transistor T15, a sixteenth thin-film transistor T16, a seventeenth thin-film transistor T17, and an eighteenth thin-film transistor T18, wherein the fourteenth thin-film transistor T14 comprises a fourteenth gate terminal, a fourteenth source terminal, and a fourteenth drain terminal; the fifteenth thin-film transistor T15 comprises a fifteenth gate terminal, a fifteenth source terminal, and a fifteenth drain terminal; the sixteenth thin-film transistor T16 comprises a sixteenth gate terminal, a sixteenth source terminal, and a sixteenth drain terminal; the seventeenth thin-film transistor T17 comprises a seventeenth gate terminal, a seventeenth source terminal, and a seventeenth drain terminal; the eighteenth thin-film transistor T18 comprises an eighteenth gate terminal, an eighteenth source terminal, and an eighteenth drain terminal; the fourteenth gate terminal, the fourteenth drain terminal, the fifteenth drain terminal, and the sixteenth gate terminal are electrically connected to the low-frequency clock signal first input terminal 25; the fourteenth source terminal is electrically connected to the fifteenth source terminal, the sixteenth drain terminal, the sixth gate terminal, and the seventh gate terminal; the fifteenth gate terminal is electrically connected to the low-frequency clock signal second input terminal 26; the sixteenth source terminal is electrically connected the seventeenth drain terminal and the eighteenth drain terminal; the seventeenth gate terminal is electrically connected to the eleventh gate terminal, the first source terminal, the one end of the capacitor $C_{b1}$, the second gate terminal, the third drain terminal, the fourth drain terminal, the sixth drain terminal, and the second output terminal 29; the seventeenth source terminal and the eighteenth source terminal are electrically connected to the low level input terminal 27; the eighteenth gate terminal is electrically connected to the (n+1)th signal input terminal 22.

In the instant embodiment, the high-frequency clock signal first input terminal 24 receives an input signal CKA of which the high/low voltages are respectively $V_{H1}/V_{L1}$, the first and second low-frequency clock signals ECK, EXCK having voltages that are complementary to each other and of which the high/low voltages are respectively $V_{H2}/V_2$, the low level input terminal 27 receiving an input of a signal that is the input signal $V_{ss}$, which has a voltage of $V_L$, wherein $V_{H1} \geq V_{H2}$ and $V_L \geq V_{L1} \geq V_{L2}$.

Figure 6A:
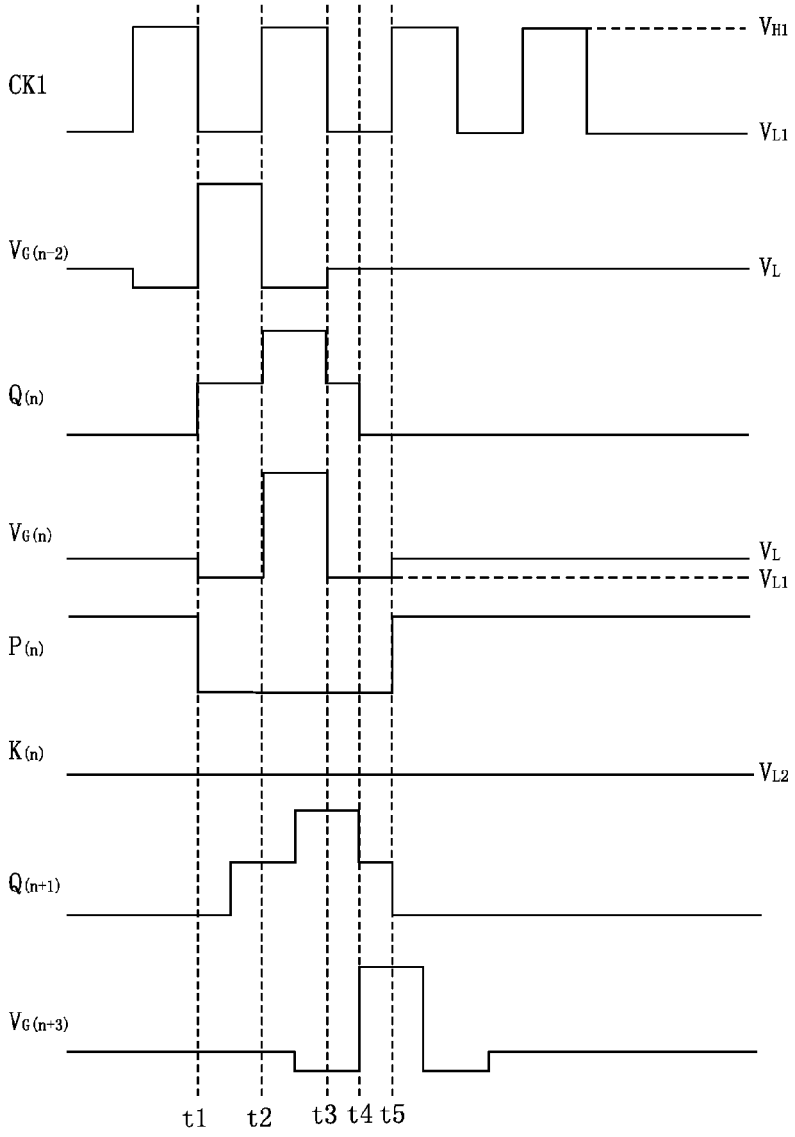
FIG. 6A is a timing diagram of the first embodiment of the gate driver unit according to the present invention.
Figure 6B:
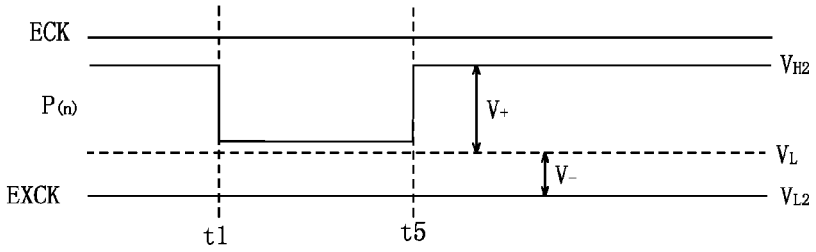
FIG. 6B is another timing diagram of the first embodiment of the gate driver unit according to the present invention.

The high-frequency clock signal first input terminal 24 receives an input signal CKA that is any one clock signal of the first high-frequency clock signal $CK_1$, the second high-frequency clock signal $CK_2$, the third high-frequency clock signal $CK_3$ and the fourth high-frequency clock signal $CK_4$. Specifically, taking the high-frequency clock signal first input terminal 24 receiving an input signal CKA that is the first high-frequency clock signal $CK_1$ as an example, when the first low-frequency clock signal ECK has a voltage of $V_{H2}$ and the second low-frequency clock signal EXCK has a voltage of $V_{L2}$, the operation of the gate driver unit is as follows:

As shown in FIGS. 6A and 6B, at time point t1, the voltage of $CK_1$ changes to $V_{L1}$ and the voltage of $V_{G(n-2)}$ is $V_{H1}$. The first TFT T1 is switched on and the signal $V_{G(n2)}$ charges $Q_{(n)}$ to $V_{H1}$-$V_{TH1}$, wherein $V_{TH1}$ is the threshold voltage of the first TFT T1. At this moment, the second TFT T2 is switched on and the voltage of $V_{G(n)}$ drops to $V_{L1}$; further, the fourteenth, the sixteenth, and the seventeenth thin-film transistors T14, T16, T17 are switched on to pull the potential of $P_{(n)}$ down to the low level and the sixth and the seventh thin-film transistors T6, T7 are switched off. Since ECK is high level, the ninth TFT T9 is switched on and the voltage at point $K_{(n)}$ is pulled by the ninth TFT T9 down to $V_{L2}$; further, since EXCK is low level, the eighth and the tenth thin-film transistors T8, T10 are switched off, whereby even though $Q_{(n)}$ makes the eleventh TFT T11 switched on, the voltage at point $K_{(n)}$ is not pulled down by the eleventh TFT T11 to the voltage $V_L$ of the input signal $V_{SS}$ and still maintains at $V_{L2}$. At this moment, the fourth and the fifth thin-film transistors T4, T5 are switched off.

At time point t2, the potential of $V_{G(n-2)}$ drops to low level and the voltage of $CK_1$ raises from $V_{L1}$ to $V_{H1}$ and, with the second TFT T2 switched on, charges the signal output terminal to have the voltage of $V_{G(n)}$ raised to $V_{H1}$. Further, since $Q_{(n)}$ is in a floating condition, due to self boosting of the capacitor, the voltage of $Q_{(n)}$ is raised to a level higher than $V_{H1}$-$V_{TH1}$, thereby enhancing the charging capability of the second TFT T2 and increasing the raising process of $V_{G(n)}$.

At time point t3, the voltage of $CK_1$ drops from $V_{H1}$ to $V_{L1}$, since $Q_{(n)}$ still maintains high level, the second TFT T2 is still on and the signal output terminal discharged through the switched-on second TFT T2 so that the voltage of $V_{G(n)}$ fast drops to $V_{L1}$. Due to self boosting of the capacitor, the voltage of $Q_{(n)}$ drops to $V_{H1}$-$V_{TH1}$.

At the time point t4, $V_{G(n-3)}$ raises to high level and the third TFT T3 is switched on and pulls the voltage of $Q_{(n)}$ down to $V_L$. At this moment, the seventeenth thin-film transistor T17 is switched off. Since $Q_{(n+1)}$ still maintains high level, the eighteenth thin-film transistor T18 is still on and continuously pulls the potential of $P_{(n)}$ down to low level.

After the high level pulse of $V_{G(n)}$ is output, the gate driver unit is in a gated condition, the voltage of $V_{G(n)}$ needs to maintain at $V_L$ in order to prevent the switching thin-film transistor associated with the pixel connected to the signal output terminal from being switched on, leading to a signal writing error. Theoretically, the potentials of $V_{G(n)}$ and $Q_{(n)}$ should be maintained at low level; however, due to the parasitic capacitance existing between the source terminal and the drain terminal of the second TFT T2, when clock $CK_1$ changes from low level to high level, a coupling voltage $\Delta V_{Q(n)}$ is induced on $Q_{(n)}$. $\Delta V_Q$(n) may cause $CK_1$ to mistakenly charge the signal output terminal, making it impossible for the potential of $V_{G(n)}$ to be maintained at low level. Thus, a dedicated pull-down unit must be provided for maintain the potential of $V_{G(n)}$ at low level.

(1) Thin-Film Transistors T6, T7 being Positively Biased and Thin-Film Transistors T4, T5 being Negatively Biased At time point t5, $Q_{(n+1)}$ drops to the low level, the eighteenth thin-film transistor T18 is switched off and ECK charges, via the fourteenth thin-film transistor T14, $P_{(n)}$ so that the raise of the voltage at $P_{(n)}$ makes the sixth and the seventh thin-film transistors T6, T7 switched on to have the voltages of $Q_{(n)}$ and $V_{G(n)}$ at $V_L$; the sixth and the seventh thin-film transistors T6, T7 are in a positively biased condition ($V_{GS}>0$), where the positive biasing voltage is $V+\approx V_{H2}-V_{TH4}$. For the fourth TFT T4 and the fifth TFT T5, since the ninth TFT T9 is switched on, the voltage at $K_{(n)}$ is maintained at $V_{L2}$. When $V_L>V_{L2}$, the fourth TFT T4 and the fifth TFT T5 are negatively biased ($V_{gs}<0$), wherein the negative biasing voltage is $V_-=V_L-V_{L2}$. V+ and V+ are schematically shown in FIG. 5B. It is noted that although the voltage $V_{L2}$ of $K_{(N)}$ is less than the voltage $V_L$ of $V_{SS}$, since the tenth TFT T10 is off, $V_{SS}$ is prevented from supplying a reversed charging current flowing through the eleventh and the twelfth thin-film transistors T11, T12 toward $K_{(n)}$, so that the voltage of $K_{(n)}$ can be maintained at $V_{L2}$ and thus setting the fourth TFT T4 and the fifth TFT T5 under negative biasing.

(2) Thin-Film Transistors T6, T7 being Negatively Biased and Thin-Film Transistors T4, T5 being Positively Biased Similarly, when the voltage of the low frequency clock is $V_{H2}$ and the voltage of ECK is $V_{L2}$, after the time point t5, $K_{(n)}$ is high level, making the fourth and the fifth thin-film transistors T4, T5 positively biased so as to maintain the voltages of $Q_{(n)}$ and $V_{G(n)}$ at $V_L$. The fifteenth thin-film transistor T15 is switched on and further, due to the sixteenth thin-film transistor T16 being cut off, $V_{SS}$ is preventing from supplying a reversed charging current flowing through the seventeenth and the eighteenth thin-film transistors T17, T18 toward $P_{(n)}$ so that the fifteenth thin-film transistor T15 can pull $P_{(n)}$ down to $V_{L2}$, setting the sixth and the seventh thin-film transistors T6, T7 in a negatively biased condition.

Figure 7:
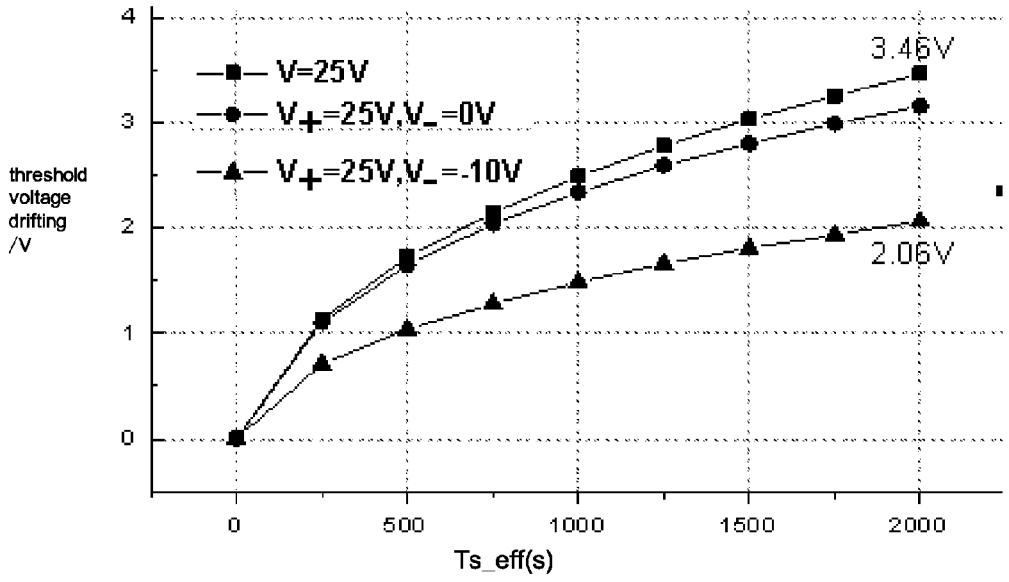
FIG. 7 is a plot showing tests of threshold voltage drifting of a thin-film transistor of a pull-down unit.
Figure 8:
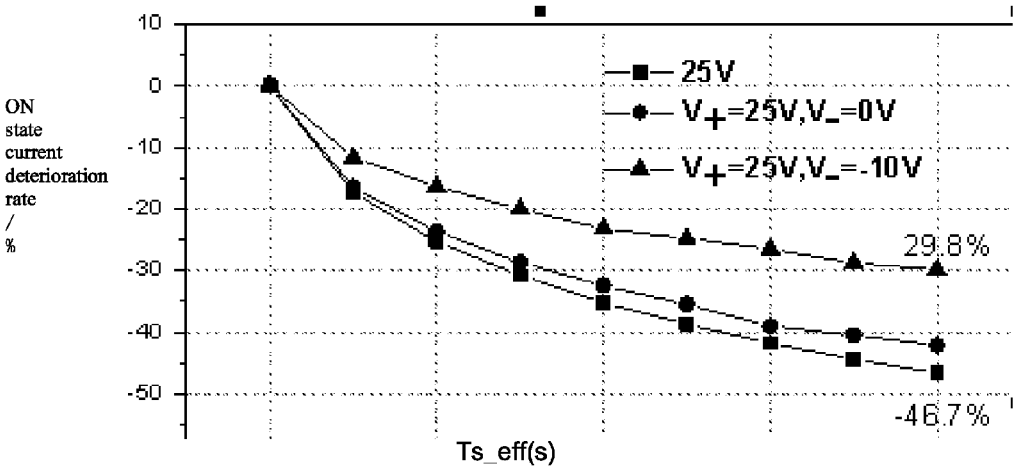
FIG. 8 is a plot showing tests of switch current deterioration of the thin-film transistor of the pull-down unit.

In the instant embodiment, the GOA circuit adopts a dual-pull-down architecture so that when ECK is high level, the first pull-down unit 45 is in a negatively biased condition and the second pull-down unit 47 pulls down the voltages of $V_{G(n)}$ and $Q_{(n)}$. And, when EXCK is high level, the first pull-down unit 45 pulls down the voltages of $V_{G(n)}$ and $Q_{(n)}$ and the second pull-down unit 47 is in a negatively biased condition. Thus, during the entire operation process, with the low-frequency clock signals ECK and EXCK switching between high and low levels, the thin-film transistors of each of the pull-down units can be set in electrical biasing of dual polarity of positivity and negativity. According to the result of electric stress tests of the thin-film transistors of the pull-down units (as shown in FIGS. 7 and 8), threshold voltage drifting of the pull-down thin-film transistors can be effectively suppressed and the lifespan of the GOA circuit can be extended. FIG. 7 shows threshold voltage drifting curves of the thin-film transistor of the pull-down unit for three stressing conditions of DC voltage (25V), single polarity pulse voltage (25V to 0V), and dual polarity pulse voltage (25V to −10V) and FIG. 8 shows deterioration rate of switching current of the thin-film transistor of the pull-down unit for three stressing conditions of direct current (25V), single polarity pulse voltage (25V to 0V), and dual polarity pulse voltage (25V to −10V). It can be observed from the tests that compared to t DC voltage and single polarity pulse voltage that are conventionally used, the threshold voltage drifting of the thin-film transistor of the pull-down unit under dual polarity pulse voltage can be remarkably suppressed and deterioration of switching current is also reduced.

Figure 9:
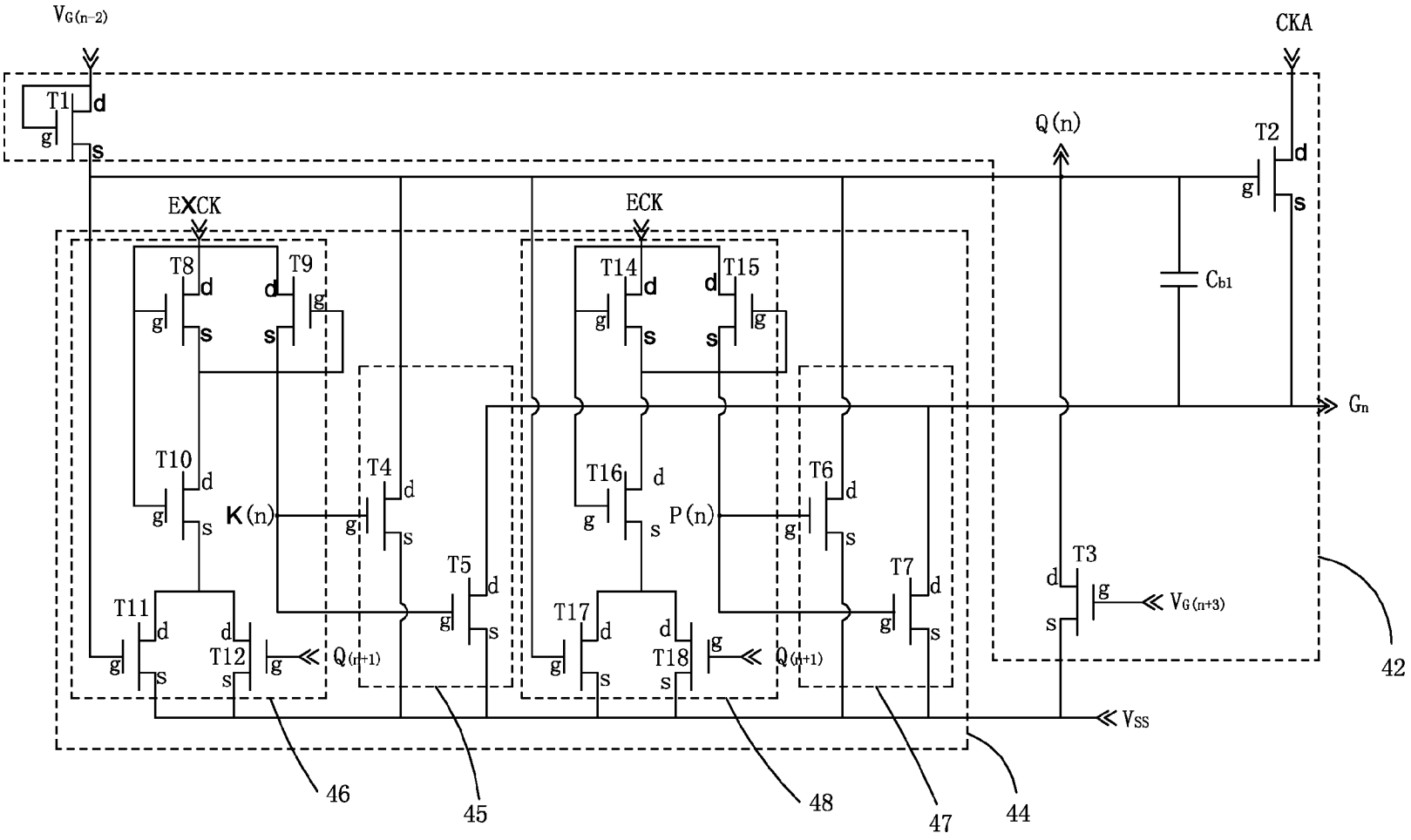
FIG. 9 is a circuit diagram of a second embodiment of the gate driver unit according to the present invention.

Referring to FIG. 9, which shows a second embodiment of the gate driver unit according to the present invention, with additional reference being had to FIGS. 1-6, the instant embodiment is generally identical to the first embodiment and a difference resides in that instant embodiment, the ninth gate terminal of the ninth TFT T9 of the first pull-down signal generation unit 46 is electrically connected to the eighth source terminal, the ninth source terminal, the tenth drain terminal, the fourth gate terminal, and the fifth gate terminal; the fifteenth gate terminal of the fifteenth thin-film transistor T15 of the second pull-down signal generation unit 48 is electrically connected to the fourteenth source terminal, the fifteenth source terminal, the sixteenth drain terminal, the sixth gate terminal, and the seventh gate terminal. Under this condition, the ninth TFT T9 and the fifteenth thin-film transistor T15 may still achieve an effect of pulling down the voltages of $K_{(n)}$ and $P_{(n)}$ and such a connection arrangement enables reduction of the loading of the low-frequency clock input terminals ECK/EXCK, being helpful to reduce power consumption of the circuit.

The operation process of the circuit of the instant embodiment is identical to the first embodiment of the gate driver unit and thus repeated description will be omitted.

Figure 10:
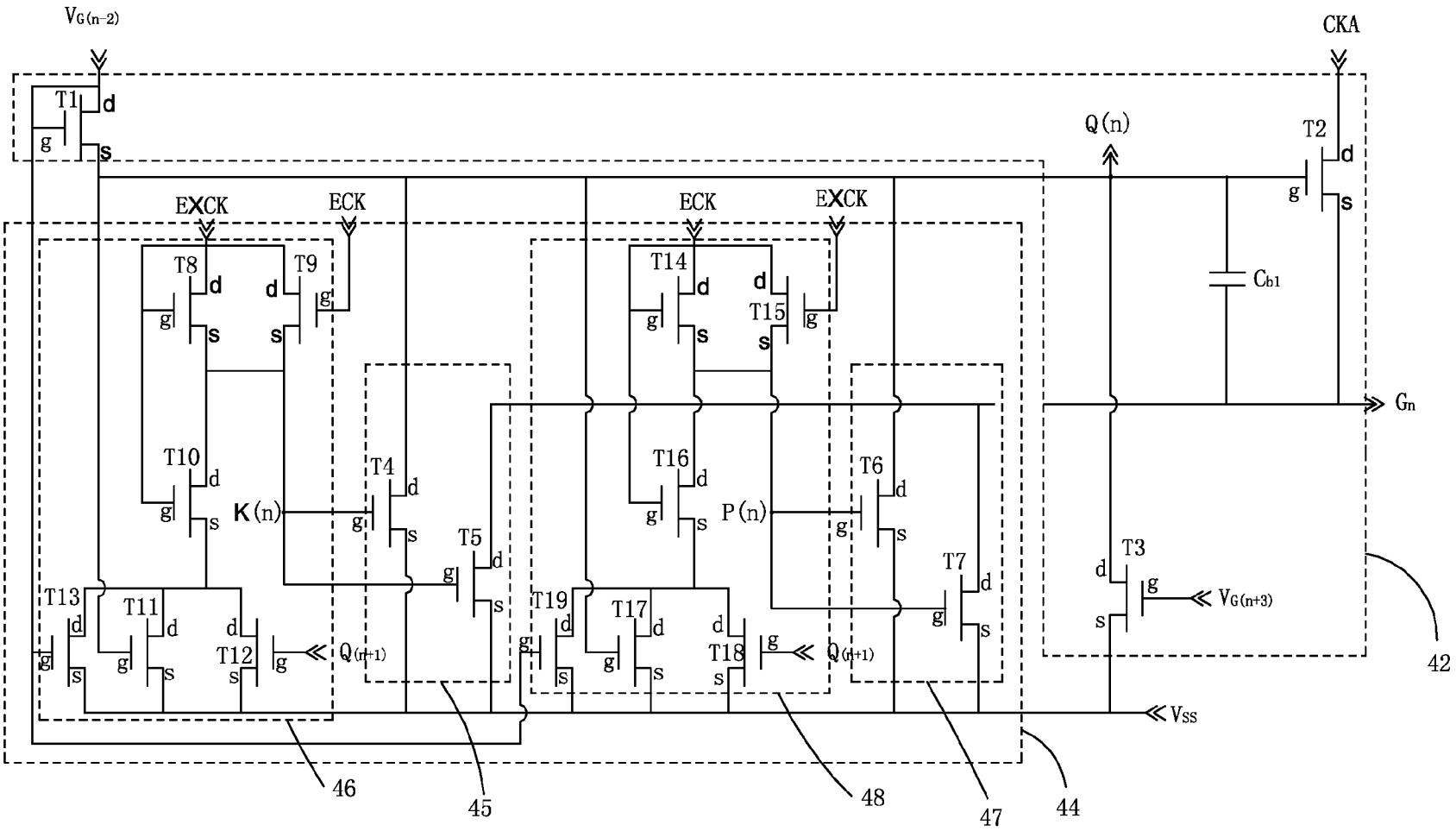
FIG. 10 is a circuit diagram of a third embodiment of the gate driver unit according to the present invention.

Referring to FIG. 10, which shows a third embodiment of the gate driver unit according to the present invention, with additional reference being had to FIGS. 1-6, the instant embodiment is generally identical to the first embodiment and a difference resides in that in the instant embodiment, the first pull-down signal generation unit 46 further comprises a thirteenth thin-film transistor T13, wherein the thirteenth thin-film transistor T13 comprises a thirteenth gate terminal, a thirteenth source terminal, and a thirteenth drain terminal; the thirteenth gate terminal is electrically connected to the first gate terminal, the first drain terminal, and the (n−2)th signal input terminal 21; the thirteenth drain terminal is electrically connected to the tenth source terminal, the eleventh drain terminal, and the twelfth drain terminal; the thirteenth source terminal is electrically connected to the low level input terminal 27; the second pull-down signal generation unit 48 further comprises a nineteenth thin-film transistor T19, wherein the nineteenth thin-film transistor T19 comprises a nineteenth gate terminal, a nineteenth source terminal, and a nineteenth drain terminal; the nineteenth gate terminal is electrically connected to the thirteenth gate terminal, the first gate terminal, the first drain terminal, and the (n−2)th signal input terminal 21; the nineteenth drain terminal is electrically connected to the sixteenth source terminal, the seventeenth drain terminal, and the eighteenth drain terminal; the nineteenth source terminal is electrically connected to the low level input terminal 27. Such a connection arrangement enhances the capability of pulling down the voltage of $K_{(n)}$ or $P_{(n)}$ in the period of t1-t2, making the circuit more suit for low temperature operations. The reasons are as follows:

In a low temperature environment, the threshold voltage of a thin-film transistor in the circuit is increased and the mobility reduced so that the electrical conduction capability of the transistor is weakened. Taking the condition where ECK is high level and EXCK is low level as an example, with reference being hand to FIGS. 5, 6A, and 10, in the period t1-t2 of the operation of the circuit, $V_{G(n-2)}$ raises to high level and charges, via thin-film transistor T1, $Q_{(n)}$ to have the voltage of $Q_{(n)}$ raised and conducting thin-film transistor T17 on so as to pull down the voltage of P(n) to have thin-film transistor T6 switched off, the charges of $Q_{(n)}$ does not leak through thin-film transistor T6 and may oppositely prompt the charging of $Q_{(n)}$, this being a positive feedback process. However, in a low temperature environment, the capability of electrical conduction of thin-film transistor T1 is weakened, making the charging speed of $Q_{(n)}$ slowed down and the capability of thin-film transistor T17 to pull down the voltage of $P_{(n)}$ reduced, whereby thin-film transistor T6 cannot be well switched off and leaking through thin-film transistor T6 cause charging failure of $Q_{(n)}$, thus resulting in circuit failure. However, in the instant embodiment, $V_{G(n-2)}$ can pull down, via thin-film transistor T19, $P_{(n)}$ to better suppress leaking through thin-film transistor T6. Similarly, when EXCK is high level and ECK is low level, the addition of thin-film transistor T13 can better suppress leaking through thin-film transistor T4. Thus, the gate driver unit of the instant embodiment is suitable for low temperature operations.

The operation process of the circuit of the instant embodiment is identical to the first embodiment of the gate driver unit and thus repeated description will be omitted.

Figure 11:
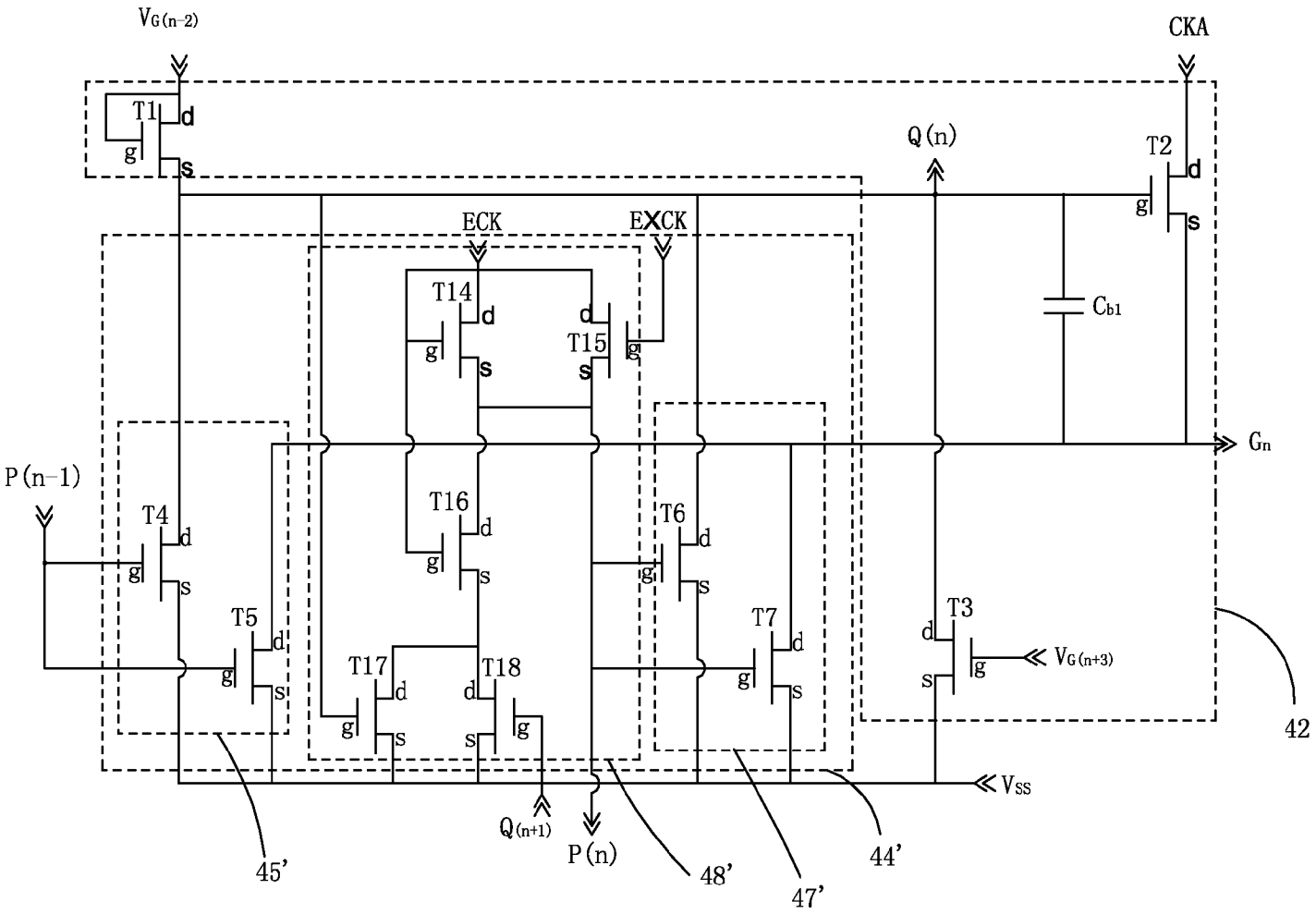
FIG. 11 is a circuit diagram of a fourth embodiment of the gate driver unit according to the present invention.

Referring to FIG. 11, which shows a fourth embodiment of the gate driver unit according to the present invention, with additional reference being had to FIGS. 1-5, compared to the first embodiment, in the instant embodiment, the nth stage gate driver unit further comprises a (n−1)th stage signal input terminal 32 and a third output terminal 33. When the nth stage gate driver unit is any one gate driver unit of the second stage to the last stage gate driver unit, the (n−1)th stage signal input terminal 32 of the nth stage gate driver unit is electrically connected to the third output terminal 33 of the (n−1)th stage gate driver unit; when the nth stage gate driver unit is the first stage gate driver unit, the nth stage gate driver unit does not comprise the (n−1)th stage signal input terminal 32; when the nth stage gate driver unit is any one gate driver unit of the first stage to the second last stage gate driver unit, the third output terminal 33 of the nth stage gate driver unit is electrically connected to the (n−1)th stage signal input terminal 32 of the (n−1)th stage gate driver unit; and when the nth stage gate driver unit is the last stage gate driver unit, the third output terminal 33 of the nth stage gate driver unit is floating;

the pull-down unit 44' comprises a first pull-down unit 45', a second pull-down unit 47', and a second pull-down signal generation unit 48', wherein the first pull-down unit 45' is electrically connected to the driving unit 42, the (n−1)th stage signal input terminal 32, and the low level input terminal 27; the second pull-down unit 47' is electrically connected to the driving unit 42, the second pull-down signal generation unit 48', the first pull-down unit 45', and the low level input terminal 27; the second pull-down signal generation unit 48' is electrically connected to the driving unit 42, the second pull-down unit 47', the low-frequency clock signal first input terminal 25, the low-frequency clock signal second input terminal 26, and the low level input terminal 27;

the first pull-down unit 45' comprises a fourth TFT T4 and a fifth TFT T5, wherein the fourth TFT T4 comprises a fourth gate terminal, a fourth source terminal, and a fourth drain terminal and the fifth TFT T5 comprises a fifth gate terminal, a fifth source terminal, and a fifth drain terminal; the fourth gate terminal and the fifth gate terminal are electrically connected to the (n−1)th stage signal input terminal 32; the fourth drain terminal is electrically connected to the first source terminal, one end of the capacitor $C_{b1}$, the second gate terminal, the third drain terminal, the second output terminal 29, the second pull-down signal generation unit 48', and the second pull-down unit 47'; the fourth source terminal and the fifth source terminal are electrically connected to the low level input terminal 27; the fifth drain terminal is electrically connected to the second source terminal, an opposite end of the capacitor $C_{b1}$, the first output terminal 28, and the second pull-down unit 47';

the second pull-down unit 46' comprises a sixth TFT T6 and a seventh TFT T7, wherein the sixth TFT T6 comprises a sixth gate terminal, a sixth source terminal, and a sixth drain terminal and the seventh TFT T7 comprises a seventh gate terminal, a seventh source terminal, and a seventh drain terminal; the sixth gate terminal is electrically connected to the second pull-down signal generation unit 48, the seventh gate terminal, and the third output terminal 33; the sixth drain terminal is electrically connected to the first source terminal, the one end of the capacitor $C_{b1}$, the second gate terminal, the third drain terminal, the fourth drain terminal, the second output terminal 29, and the second pull-down signal generation unit 48'; the sixth source terminal and the seventh source terminal are electrically connected to the low level input terminal 27; the seventh drain terminal is electrically connected to the second source terminal, the opposite end of the capacitor $C_{b1}$, the first output terminal 28, and the fifth drain terminal;

the second pull-down signal generation unit 48' comprises a fourteenth thin-film transistor T14, a fifteenth thin-film transistor T15, a sixteenth thin-film transistor T16, a seventeenth thin-film transistor T17, and an eighteenth thin-film transistor T18, wherein the fourteenth thin-film transistor T14 comprises a fourteenth gate terminal, a fourteenth source terminal, and a fourteenth drain terminal; the fifteenth thin-film transistor T15 comprises a fifteenth gate terminal, a fifteenth source terminal, and a fifteenth drain terminal; the sixteenth thin-film transistor T16 comprises a sixteenth gate terminal, a sixteenth source terminal, and a sixteenth drain terminal; the seventeenth thin-film transistor T17 comprises a seventeenth gate terminal, a seventeenth source terminal, and a seventeenth drain terminal; the eighteenth thin-film transistor T18 comprises an eighteenth gate terminal, an eighteenth source terminal, and an eighteenth drain terminal; the fourteenth gate terminal, the fourteenth drain terminal, the fifteenth drain terminal, and the sixteenth gate terminal are electrically connected to the low-frequency clock signal first input terminal 25; the fourteenth source terminal is electrically connected to the fifteenth source terminal, the sixteenth drain terminal, the sixth gate terminal, the seventh gate terminal, and the third output terminal 33; the fifteenth gate terminal is electrically connected to the low-frequency clock signal second input terminal 26; the sixteenth source terminal is electrically connected to the seventeenth drain terminal and the eighteenth drain terminal; the seventeenth gate terminal is electrically connected to the first source terminal, the one end of the capacitor, the second gate terminal, the third drain terminal, the fourth drain terminal, and the sixth drain terminal; the seventeenth source terminal and the eighteenth source terminal are electrically connected to the low level input terminal 27; the eighteenth gate terminal is electrically connected to the (n+1)th signal input terminal 22.

In the instant embodiment, the gate driver unit adopts a dual-pull-down sharable architecture. In other words, the gate driver units of two adjacent stages share the same pull-down signal generation unit. As such, one stage of gate driver unit can save one first pull-down signal generation unit and an individual stage of gate driver unit can reduce the number of transistors, making the circuit structure simplified.

Figure 12A:
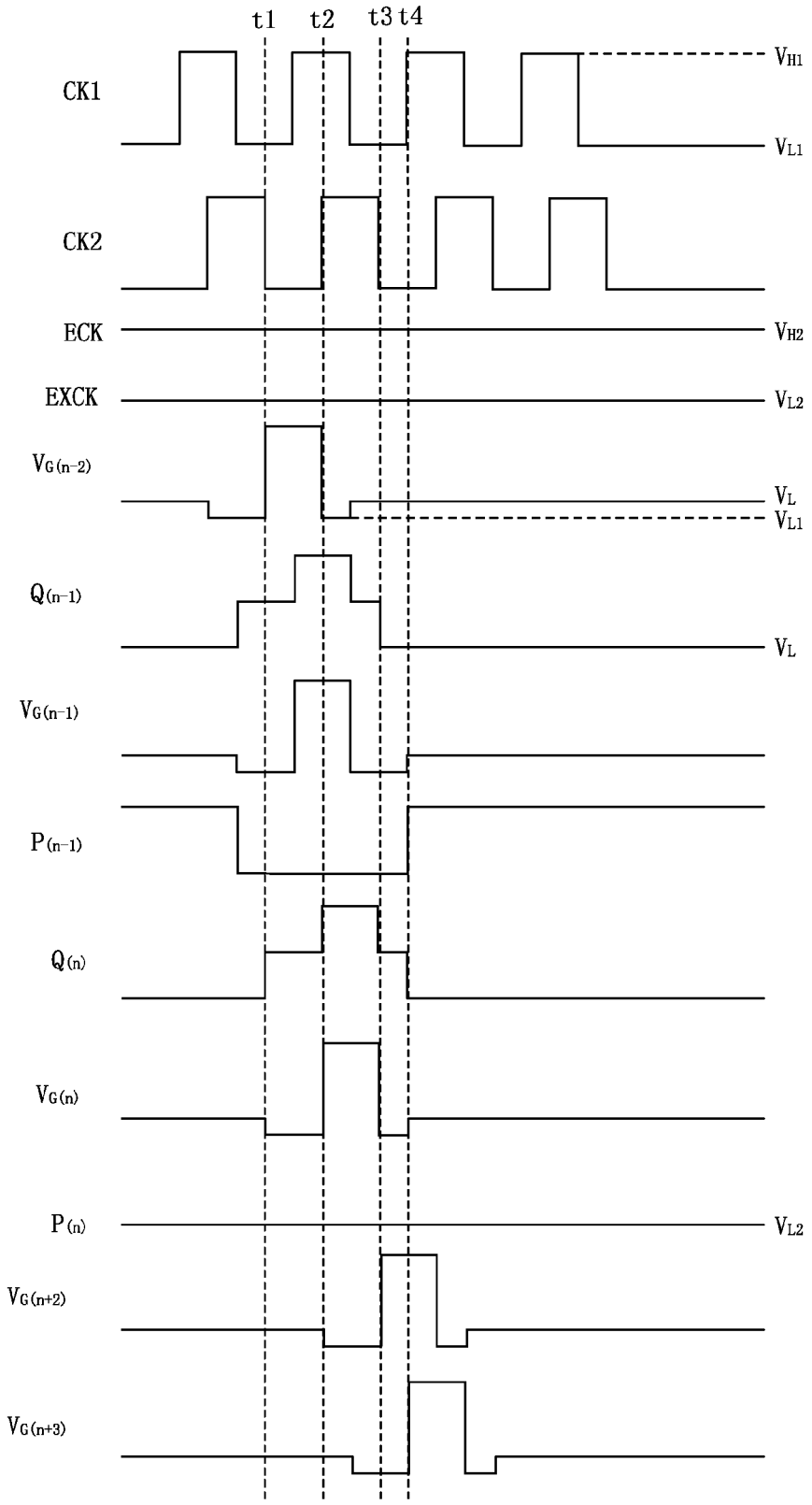
FIG. 12A is a timing diagram of the fourth embodiment of the gate driver unit according to the present invention.
Figure 12B:
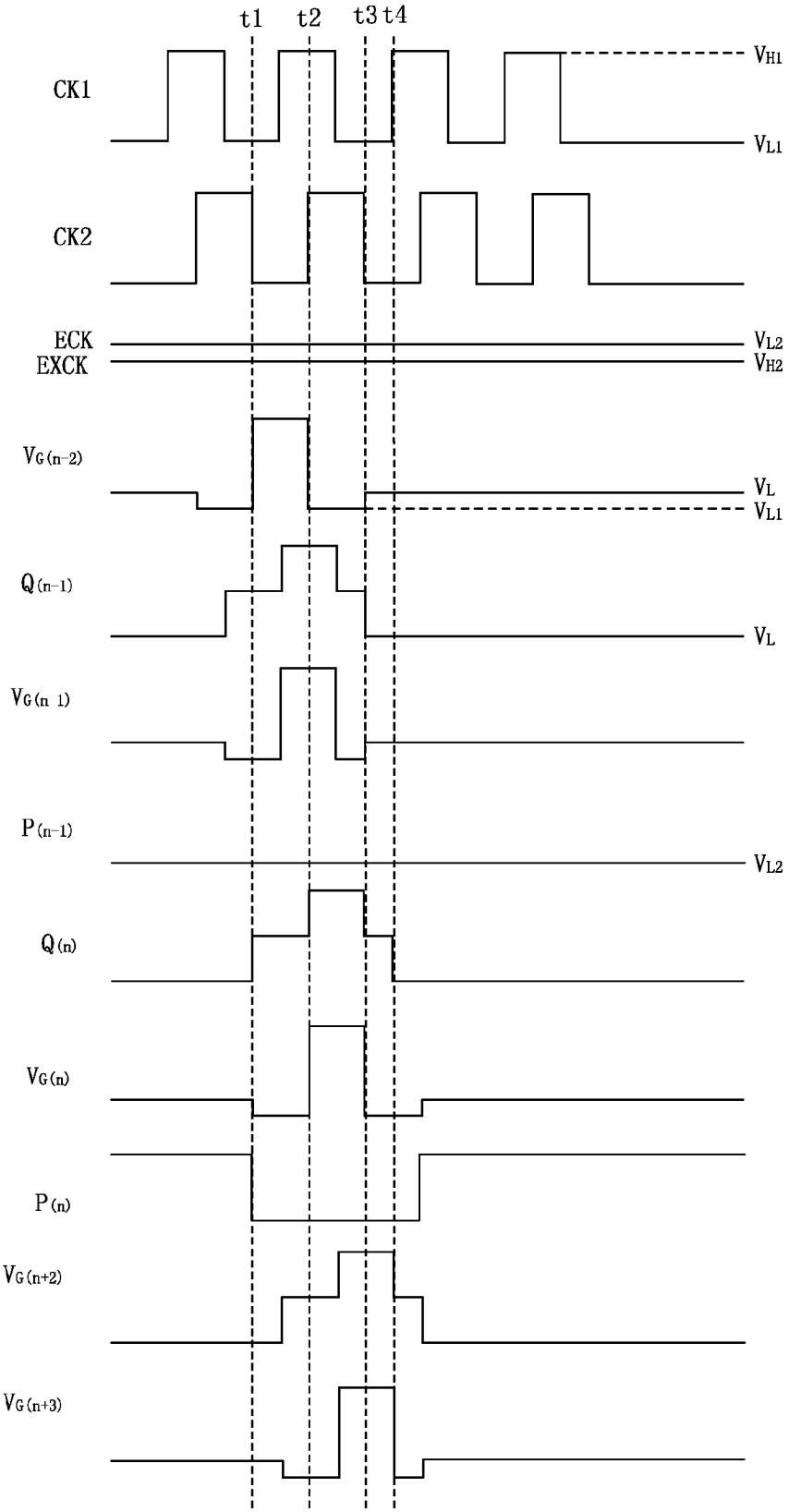
FIG. 12B is another timing diagram of the fourth embodiment of the gate driver unit according to the present invention.

As shown in FIG. 12A, when ECK is high level, after time point t4, the voltage of $P_{(n-1)}$ is high level and the transistors T4, T5 of the nth stage gate driver unit are switched on to have the voltages of $Q_{(n)}$ and $V_{G(n)}$ maintained at $V_L$. As shown in FIG. 12B, when EXCK is high level, after time point t4, the voltage of $P_{(n)}$ is high level and the transistors T6, T7 of the nth stage gate driver circuit unit are switched on to have the voltages of $Q_{(n-1)}$, $V_{G(n-1)}$, $Q_{(n)}$, and $V_{G(n)}$ maintained at $V_L$. For the nth stage gate driver circuit unit, in the entire operation process, the transistors T6/T7 and the transistors T4/T5 are subjected to dual polarity electrical biasing of positivity and negativity to effectively suppress the threshold voltage drifting thereof.

Figure 13:
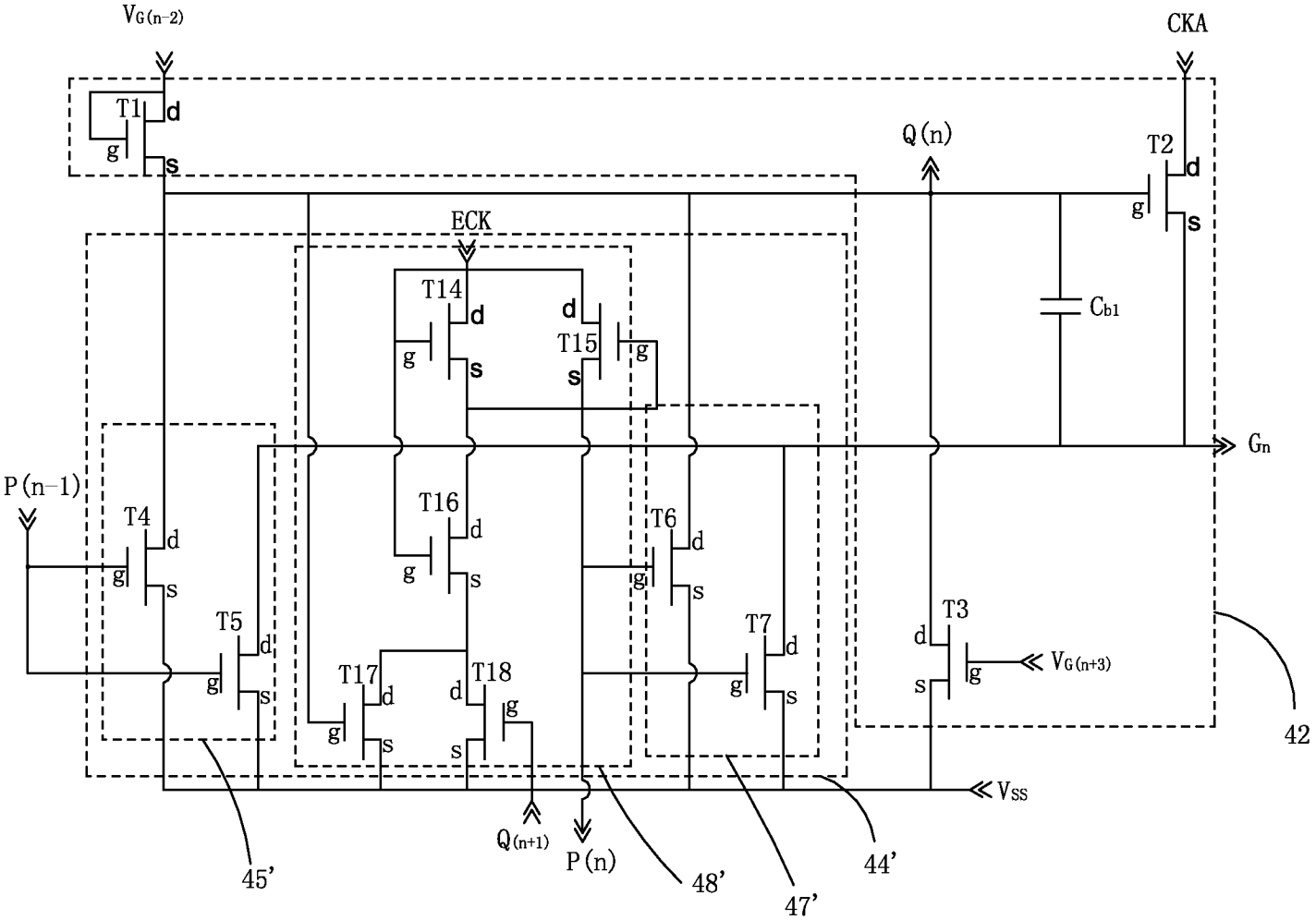
FIG. 13 is a circuit diagram of a fifth embodiment of the gate driver unit according to the present invention.

Referring to FIG. 13, which shows a fifth embodiment of the gate driver unit according to the present invention, with additional reference being had to FIGS. 1-5 and 11-12B, the instant is generally identical to the fourth embodiment and a difference resides in that in the instant embodiment, the fifteenth gate terminal of the fifteenth thin-film transistor T15 of the second pull-down signal generation unit 48' is electrically connected to the fourteenth source terminal, the fifteenth source terminal, the sixteenth drain terminal, the sixth gate terminal, the seventh gate terminal, and the third output terminal 33. Such a connection arrangement enables reduction the loading of the low-frequency clock input terminals ECK/EXCK, being helpful to reduce power consumption of the circuit.

The operation process of the circuit of the instant embodiment is identical to the fourth embodiment of the gate driver unit and thus repeated description will be omitted.

Figure 14:
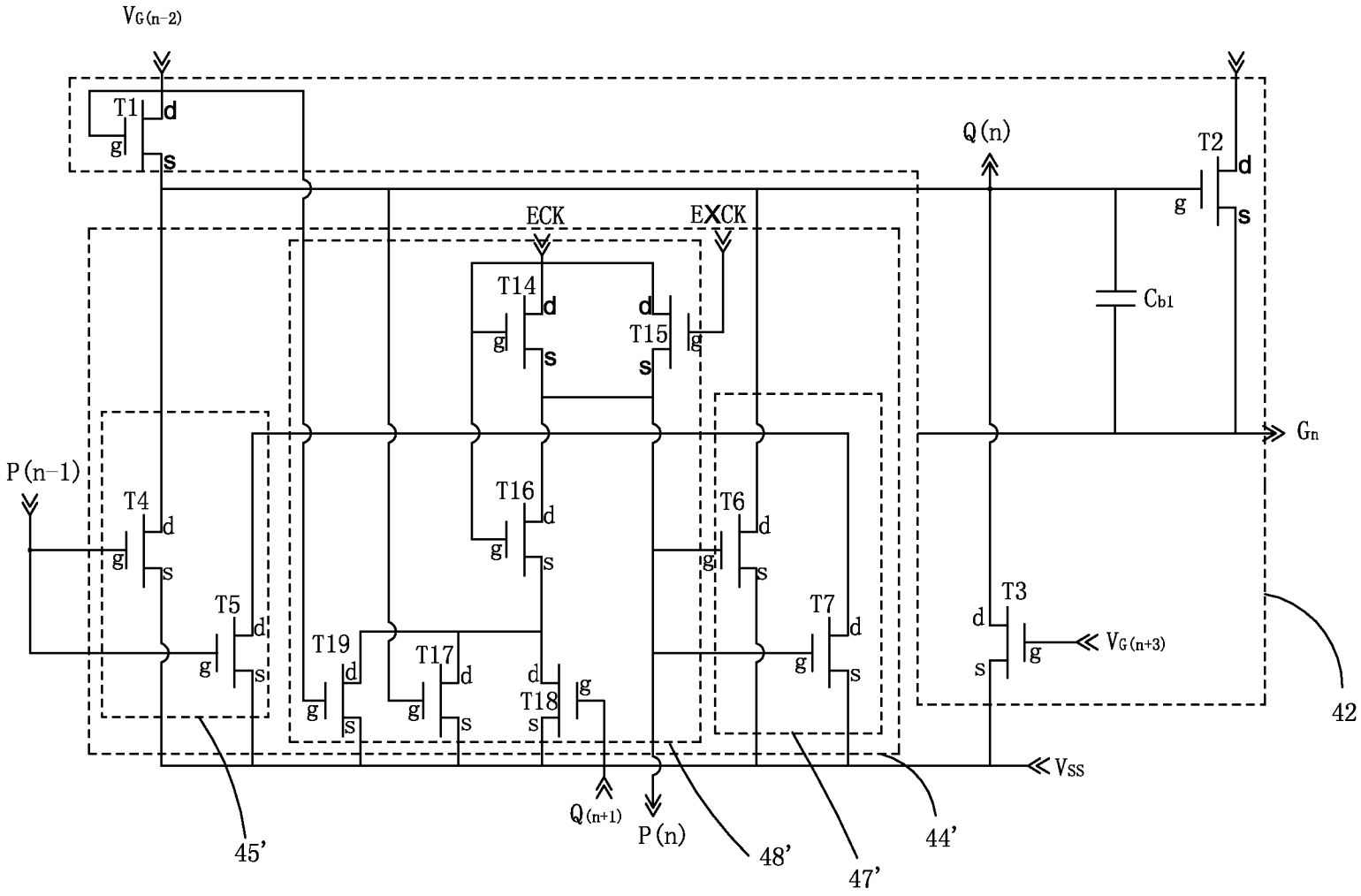
FIG. 14 is a circuit diagram of a sixth embodiment of the gate driver unit according to the present invention.

Referring to FIG. 14, which shows a sixth embodiment of the gate driver unit according to the present invention, with additional reference being had to FIGS. 1-5 and 11-12B, the instant is generally identical to the fourth embodiment and a difference resides in that in the instant embodiment, the second pull-down signal generation unit 48' further comprises the nineteenth thin-film transistor T19, wherein the nineteenth thin-film transistor T19 comprises a nineteenth gate terminal, a nineteenth source terminal, and a nineteenth drain terminal; the nineteenth gate terminal is electrically connected to the first gate terminal, the first drain terminal, and the (n−2)th signal input terminal 21; the nineteenth drain terminal is electrically connected to the sixteenth source terminal, the seventeenth drain terminal, and the eighteenth drain terminal; the nineteenth drain terminal is electrically connected to the low level input terminal 27. Such a connection arrangement enhances the capability of pulling down the voltage of $P_{(n)}$ in the period of t1-t2, making the circuit more suit for low temperature operations. The reasons are as follows:

In a low temperature environment, the threshold voltage of a thin-film transistor in the circuit is increased and the mobility reduced so that the electrical conduction capability of the transistor is weakened. Taking the condition where ECK is high level and EXCK is low level as an example, with reference being hand to FIGS. 5, 6A, and 10; in the period t1-t2 of the operation of the circuit, $V_{G(n-2)}$ raises to high level and charges, via thin-film transistor T1, $Q_{(n)}$ to have the voltage of $Q_{(n)}$ raised and conducting thin-film transistor T17 on so as to pull down the voltage of P(n) to have thin-film transistor T6 switched off, the charges of $Q_{(n)}$ does not leak through thin-film transistor T6 and may oppositely prompt the charging of $Q_{(n)}$, this being a positive feedback process. However, in a low temperature environment, the capability of electrical conduction of thin-film transistor T1 is weakened, making the charging speed of $Q_{(n)}$ slowed down and the capability of thin-film transistor T17 to pull down the voltage of $P_{(n)}$ reduced, whereby thin-film transistor T6 cannot be well switched off and leaking through thin-film transistor T6 cause charging failure of $Q_{(n)}$, thus resulting in circuit failure. However, in the instant embodiment, $V_{G(n-2)}$ can pull down, via thin-film transistor T19, $P_{(n)}$ to better suppress leaking through thin-film transistor T6. Thus, the gate driver unit of the instant embodiment is suitable for low temperature operations.

Figure 15:
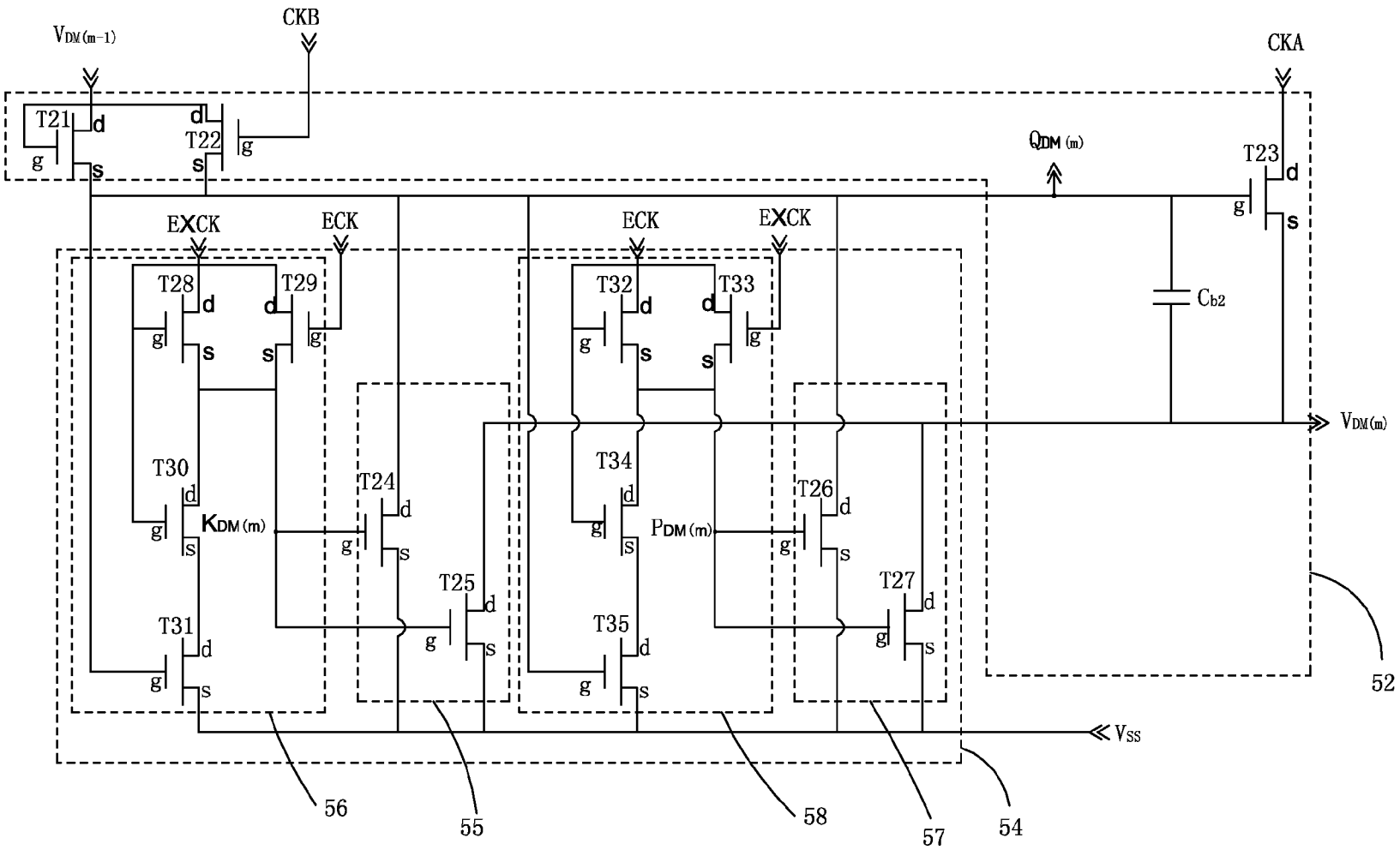
FIG. 15 is a circuit diagram of a first embodiment of the supplementary gate driver unit according to the present invention.
Figure 16:
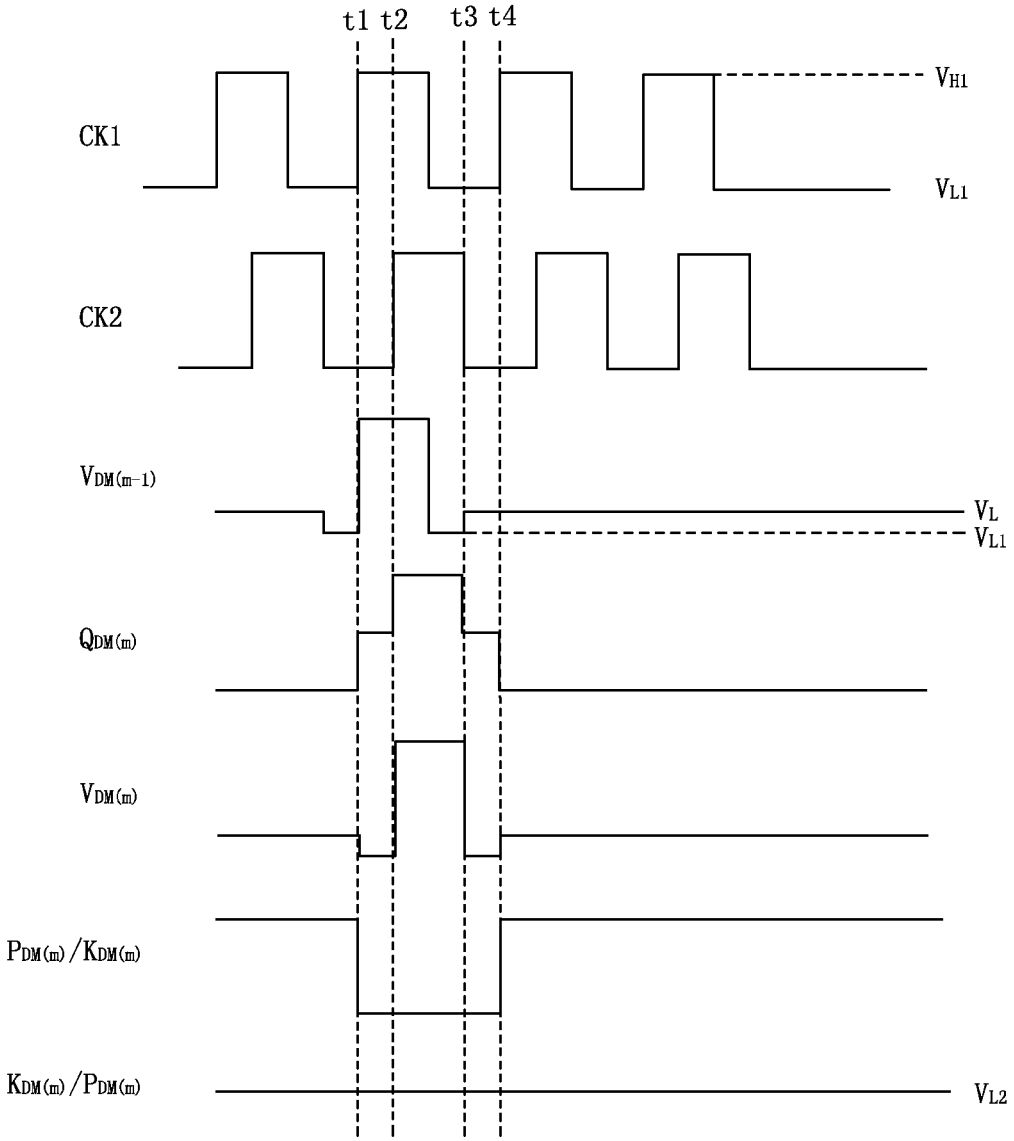
FIG. 16 is a timing diagram of the first embodiment of the supplementary gate driver unit according to the present invention.

The operation process of the circuit of the instant embodiment is identical to the fourth embodiment of the gate driver unit and thus repeated description will be omitted. Referring to FIGS. 15 to 16, which shows a first embodiment of the supplementary gate driver unit according to the present invention, with additional reference being had to FIGS. 4 and 1-2B, the supplementary driving unit 52 comprises a supplementary capacitor $C_{b2}$, a twenty-first thin-film transistor T21, a twenty-second thin-film transistor T22, and a twenty-third thin-film transistor T23, wherein the twenty-first thin-film transistor T21 comprises a twenty-first gate terminal, a twenty-first source terminal, and a twenty-first drain terminal; the twenty-second thin-film transistor T22 comprises a twenty-second gate terminal, a twenty-second source terminal, and a twenty-second drain terminal; the twenty-third thin-film transistor T23 comprises a twenty-third gate terminal, a twenty-third source terminal, and a twenty-third drain terminal; the twenty-first gate terminal, the twenty-first drain terminal, and the twenty-second drain terminal are electrically connected to the (m−1)th supplementary signal input terminal 35; the twenty-first source terminal is electrically connected to one end of the supplementary capacitor $C_{b2}$, the twenty-third gate terminal, the twenty-second source terminal, the second supplementary output terminal 39, and the supplementary pull-down unit 54; the twenty-second gate terminal is electrically connected to the high-frequency clock signal second input terminal 34; the twenty-third drain terminal is electrically connected to the high-frequency clock signal first input terminal 24; the twenty-third source terminal is electrically connected to an opposite end of the supplementary capacitor $C_{b2}$, the first supplementary output terminal 38, and the supplementary pull-down unit 54;

the supplementary pull-down unit 54 comprises a first supplementary pull-down unit 55, a first supplementary pull-down signal generation unit 56, a second supplementary pull-down unit 57, and a second supplementary pull-down signal generation unit 58, wherein the first supplementary pull-down unit 55 is electrically connected to the supplementary driving unit 52, the first supplementary pull-down signal generation unit 56, the second supplementary pull-down unit 57, and the low level input terminal 27; the first supplementary pull-down signal generation unit 56 is electrically connected to the first supplementary pull-down unit 55, the low-frequency clock signal first input terminal 25, the low-frequency clock signal second input terminal 26, and the low level input terminal 27; the second supplementary pull-down unit 57 is electrically connected to the supplementary driving unit 52, the second supplementary pull-down signal generation unit 58, the first supplementary pull-down unit 55, and the low level input terminal 27; the second supplementary pull-down signal generation unit 58 is electrically connected to the second supplementary pull-down unit 57, the low-frequency clock signal first input terminal 25, the low-frequency clock signal second input terminal 26, and the low level input terminal 27;

the first supplementary pull-down unit 55 comprises a twenty-fourth thin-film transistor T24 and a twenty-fifth thin-film transistor T25, wherein the twenty-fourth thin-film transistor T24 comprises a twenty-fourth gate terminal, a twenty-fourth source terminal, and a twenty-fourth drain terminal and the twenty-fifth thin-film transistor T25 comprises a twenty-fifth gate terminal, a twenty-fifth source terminal, and a twenty-fifth drain terminal; the twenty-fourth gate terminal is electrically connected to the first supplementary pull-down signal generation unit 56 and the twenty-fifth gate terminal; the twenty-fourth drain terminal is electrically connected to the twenty-first source terminal, the twenty-second source terminal, the one end of the supplementary capacitor $C_{b2}$, the twenty-third gate terminal, the second supplementary output terminal 39, the second supplementary pull-down signal generation unit 58, and the second supplementary pull-down unit 56; the twenty-fourth source terminal is electrically connected to the low level input terminal 27; the twenty-fifth drain terminal is electrically connected to the opposite end of the supplementary capacitor $C_{b2}$, the first supplementary output terminal 38, and the second supplementary pull-down unit 57; the twenty-fifth source terminal is electrically connected to the low level input terminal 27;

the second supplementary pull-down unit 56 comprises a twenty-sixth thin-film transistor T26 and a twenty-seventh thin-film transistor T27, wherein the twenty-sixth thin-film transistor T26 comprises a twenty-sixth gate terminal, a twenty-sixth source terminal, and a twenty-sixth drain terminal and the twenty-seventh thin-film transistor T27 comprises a twenty-seventh gate terminal, a twenty-seventh source terminal, and a twenty-seventh drain terminal; the twenty-sixth gate terminal is electrically connected to the second supplementary pull-down signal generation unit 58 and the twenty-seventh gate terminal; the twenty-sixth source terminal is electrically connected to the low level input terminal 27; the twenty-sixth drain terminal is electrically connected to the twenty-fourth source terminal, the twenty-first source terminal, the twenty-second source terminal, the one end of the supplementary capacitor $C_{b2}$, the twenty-third gate terminal, the second supplementary output terminal 39, and the second supplementary pull-down signal generation unit 58; the twenty-seventh drain terminal is electrically connected to the opposite end of the supplementary capacitor $C_{b2}$, the first supplementary output terminal 38, the twenty-fifth drain terminal, and the twenty-third source terminal; the twenty-seventh source terminal is electrically connected to the low level input terminal 27;

the first supplementary pull-down signal generation unit 56 comprises a twenty-eighth thin-film transistor T28, a twenty-ninth thin-film transistor T29, a thirtieth thin-film transistor T30, and a thirty-first thin-film transistor T31, wherein the twenty-eighth thin-film transistor T28 comprises a twenty-eighth gate terminal, a twenty-eighth source terminal, and a twenty-eighth drain terminal; the twenty-ninth thin-film transistor T29 comprises a twenty-ninth gate terminal, a twenty-ninth source terminal, and a twenty-ninth drain terminal; the thirtieth thin-film transistor T30 comprises a thirtieth gate terminal, a thirtieth source terminal, and a thirtieth drain terminal; the thirty-first thin-film transistor T31 comprises a thirty-first gate terminal, a thirty-first source terminal, and a thirty-first drain terminal; the twenty-eighth gate terminal, the twenty-eighth drain terminal, the twenty-ninth drain terminal, and the thirtieth gate terminal are electrically connected to the low-frequency clock signal second input terminal 26; the twenty-eighth source terminal is electrically connected to the twenty-ninth source terminal, the thirtieth drain terminal, the twenty-fourth gate terminal, and the twenty-fifth gate terminal; the twenty-ninth gate terminal is electrically connected to the low-frequency clock signal first input terminal 25; the thirtieth source terminal is electrically connected to the thirty-first drain terminal; the thirty-first gate terminal is electrically connected to the twenty-first source terminal, the twenty-second source terminal, the one end of the supplementary capacitor $C_{b2}$, the twenty-third gate terminal, the second supplementary output terminal 39, the twenty-sixth drain terminal, and the twenty-fourth drain terminal; the thirty-first source terminal is electrically connected to the low level input terminal 27;

the second supplementary pull-down signal generation unit 58 comprises a thirty-second thin-film transistor T32, a thirty-third thin-film transistor T33, a thirty-fourth thin-film transistor T34, and a thirty-fifth thin-film transistor T35, wherein the thirty-second thin-film transistor T32 comprises a thirty-second gate terminal, a thirty-second source terminal, and a thirty-second drain terminal; the thirty-third thin-film transistor T33 comprises a thirty-third gate terminal, a thirty-third source terminal, and a thirty-third drain terminal; the thirty-fourth thin-film transistor T34 comprises a thirty-fourth gate terminal, a thirty-fourth source terminal, and a thirty-fourth drain terminal; the thirty-fifth thin-film transistor T35 comprises a thirty-fifth gate terminal, a thirty-fifth source terminal, and a thirty-fifth drain terminal; the thirty-second gate terminal, the thirty-second drain terminal, the thirty-third drain terminal, and the thirty-fourth gate terminal are electrically connected to the low-frequency clock signal first input terminal 25; the thirty-second source terminal is electrically connected to the thirty-third source terminal, the thirty-fourth drain terminal, the twenty-sixth gate terminal, and the twenty-seventh gate terminal; the thirty-third gate terminal is electrically connected to the low-frequency clock signal second input terminal 26; the thirty-fourth source terminal is electrically connected to the thirty-fifth drain terminal; the thirty-fifth gate terminal is electrically connected to the thirty-first gate terminal, the twenty-first source terminal, the twenty-second source terminal, the one end of the supplementary capacitor $C_{b2}$, the twenty-third gate terminal, the second supplementary output terminal 39, the twenty-sixth drain terminal, and the twenty-fourth drain terminal; the thirty-fifth source terminal is electrically connected to the low level input terminal 27.

As shown in FIG. 16, the operation process of the circuit of the instant embodiment is similar to the first embodiment of the gate driver unit and a difference resides in that at time point t1, the transistors T21, T22 are simultaneously switched on for charging $Q_{DM(N)}$; at time point t4, the transistor T22 takes the place of the transistor T3 of the first embodiment of the gate driver unit to discharge to $Q_{DM(N)}$; after time point t4, the transistor T22 is controlled by a signal input from the clock signal second input terminal CKB to pull down the voltage of $Q_{DM(N)}$ to $V_L$, effectively suppressing the feed-through effect of the circuit with respect to the clock. The instant embodiment does not require an additionally supplied signal $V_{G(N+3)}$ and also does not require an additionally supplied signal $Q_{(N+1)}$. Thus, in a cascade connection of multiple stages, an advantage of the gate driver unit of the present invention is that there is no need for a rear stage to supply a feedback signal.

Figure 17:
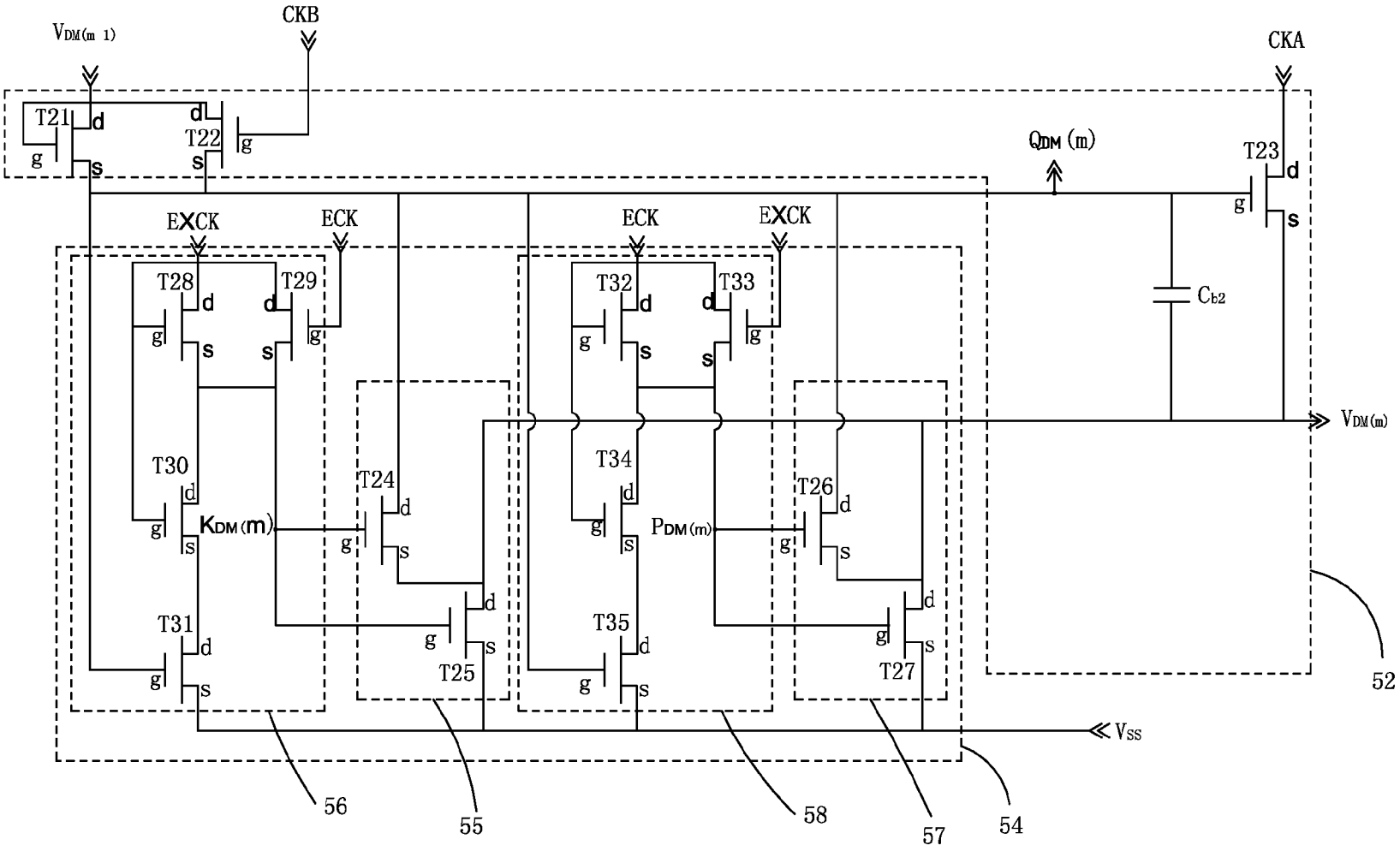
FIG. 17 is a circuit diagram of a second embodiment of the supplementary gate driver unit according to the present invention.

Referring to FIG. 17, which shows a second embodiment of the supplementary gate driver unit according to the present invention, with additional reference being had to FIGS. 15-16 and FIGS. 1-4, the instant embodiment is generally identical to the first embodiment of the supplementary driving unit and a difference resides in that in the instant embodiment, the twenty-fourth source terminal of the twenty-fourth thin-film transistor of the first supplementary pull-down unit 55 is electrically connected to the twenty-fifth drain terminal, the opposite end of the supplementary capacitor $C_{b2}$, the first supplementary output terminal 38, and the second supplementary pull-down unit 57; the twenty-sixth source terminal of the twenty-sixth thin-film transistor of the second supplementary pull-down unit 56 is electrically connected to the twenty-seventh drain terminal, the opposite end of the supplementary capacitor $C_{b2}$, the first supplementary output terminal 38, the twenty-fifth drain terminal, and the twenty-third source terminal. Such a connection arrangement is helpful to suppress leaking of the twenty-fourth thin-film transistor and the twenty-sixth transistor in high temperatures in the period of t2-t3, making the circuit suitable for high temperature operations. The reasons are as follows:

In a high temperature environment, the threshold voltage of a thin-film transistor in the circuit is reduced and the mobility increased so that the electrical conduction capability of the transistor is enhanced. Taking the condition where ECK is high level and EXCK is low level as an example, with reference being hand to FIGS. 15, 16, and 17, in the period t2-t3 of the operation of the circuit, $CK_1$ charges, via thin-film transistor T23, $V_{DM(n)}$ and $V_{DM(n)}$ is raised to high level and is subjected to capacitance self boosting to raise the voltage of $Q_{DM(n)}$, which in turn increase the speed of raising of $V_{DM(n)}$, this being a positive feedback process. However, in a high temperature, the capability of electrical conduction of the transistor T26 is enhanced, making $Q_{DM(n)}$ leaking through the transistor T26 and thus damaging the above described process, resulting in circuit failure. However, in the instant embodiment, the twenty-sixth source terminal is connected to $V_{DM(n)}$, making the gate-source voltage of thin-film transistor T26 negative in the period t2-t3 of the operation of the circuit thus effectively suppressing leaking of thin-film transistor T26. Similarly, when EXCK is high level and ECK is low level, leaking of thin-film transistor T24 can also be suppressed. Thus, the supplementary gate driver unit of the instant embodiment is suitable for high temperature operations.

The operation process of the circuit of the instant embodiment is identical to the first embodiment of the supplementary gate driver unit and thus repeated description will be omitted.

Figure 18:
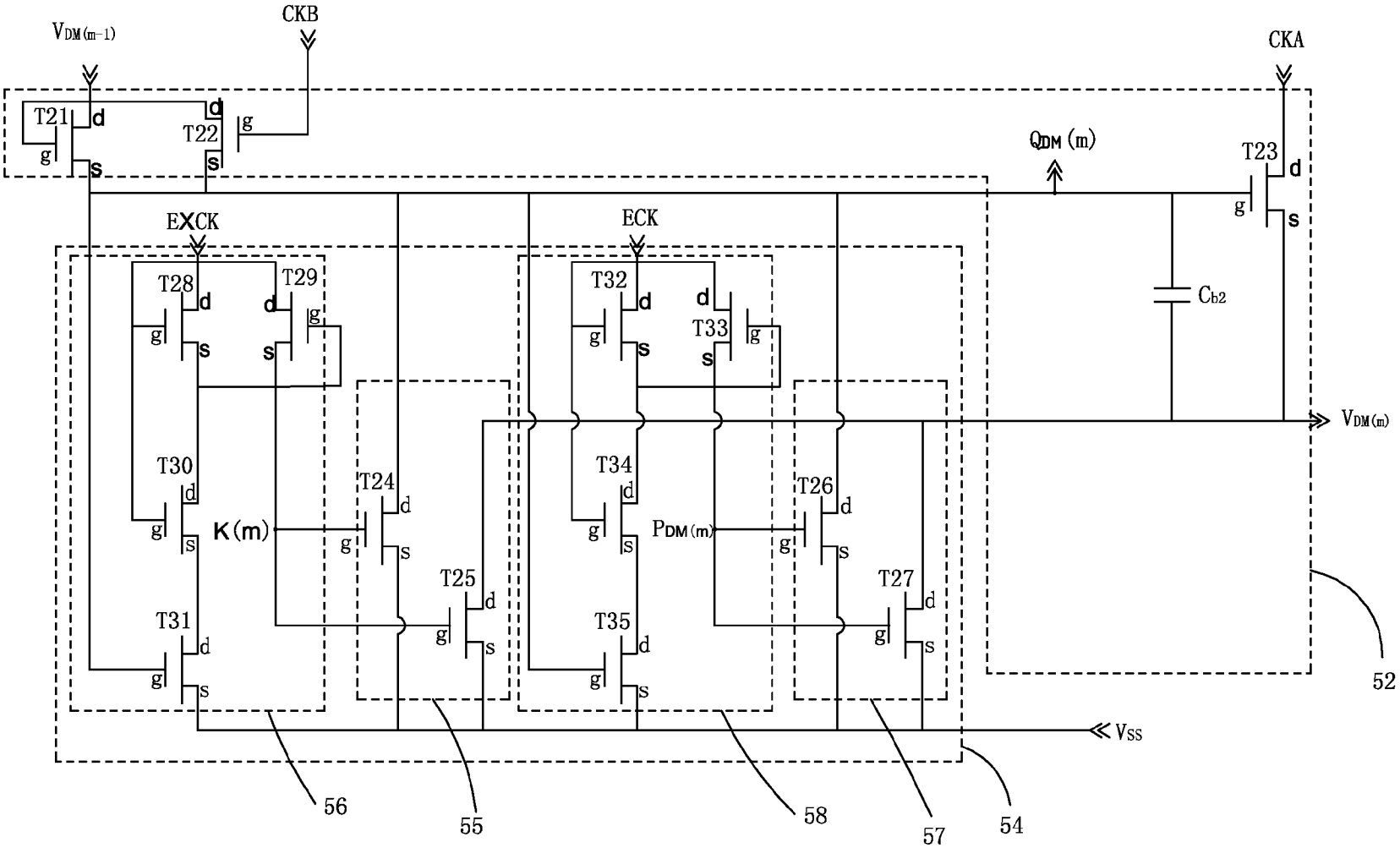
FIG. 18 is a circuit diagram of a third embodiment of the supplementary gate driver unit according to the present invention.

Referring to FIG. 18, which shows a third embodiment of the supplementary gate driver unit according to the present invention, with additional reference being had to FIGS. 15-16 and 1-4, the instant embodiment is generally identical to the first embodiment of the supplementary driving unit and a difference resides in that in the instant embodiment, the twenty-ninth gate terminal of the first supplementary pull-down signal generation unit 56 is electrically connected to the twenty-eighth source terminal, the twenty-ninth source terminal, the thirtieth drain terminal, the twenty-fourth gate terminal, and the twenty-fifth gate terminal; the thirty-third gate terminal of the second supplementary pull-down signal generation unit 58 is electrically connected to the thirty-second source terminal, the thirty-third source terminal, the thirty-fourth drain terminal, the twenty-sixth gate terminal, and the twenty-seventh gate terminal. Such a connection arrangement enables reduction of the loading of the low-frequency clock input terminals ECK/EXCK, being helpful to reduce power consumption of the circuit.

The operation process of the circuit of the instant embodiment is identical to the first embodiment of the supplementary gate driver unit and thus repeated description will be omitted.

Figure 19:
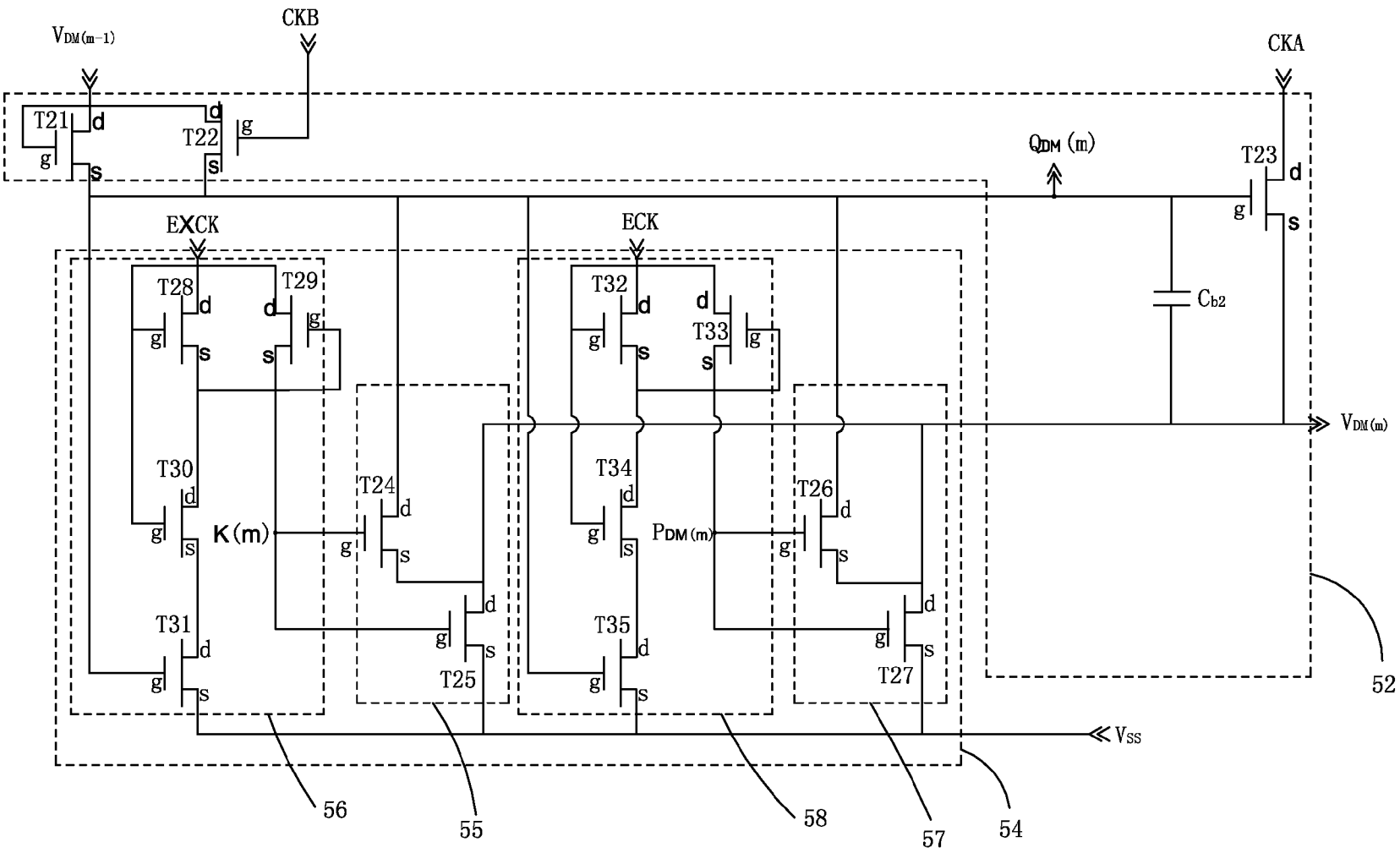
FIG. 19 is a circuit diagram of a fourth embodiment of the supplementary gate driver unit according to the present invention.

Referring to FIG. 19, which shows a fourth embodiment of the supplementary gate driver unit according to the present invention, with additional reference being had to FIGS. 15-16, 18, and 1-4, the instant embodiment is generally identical to the third embodiment of the supplementary driving unit and a difference resides in that in the instant embodiment, the twenty-fourth source terminal of the twenty-fourth thin-film transistor of the first supplementary pull-down unit 55 is electrically connected to the twenty-fifth drain terminal, the opposite end of the supplementary capacitor $C_{b2}$, the first supplementary output terminal 38, and the second supplementary pull-down unit 57; the twenty-sixth source terminal of the twenty-sixth thin-film transistor of the second supplementary pull-down unit 56 is electrically connected to the twenty-seventh drain terminal, the opposite end of the supplementary capacitor $C_{b2}$, the first supplementary output terminal 38, the twenty-fifth drain terminal, and the twenty-third source terminal. Such a connection arrangement helps suppress leaking of the twenty-fourth thin-film transistor and the twenty-sixth transistor in a high temperature in a self-boosting period, making the circuit suitable for high temperature operations.

The operation process of the circuit of the instant embodiment is identical to the first embodiment of the supplementary gate driver unit and thus repeated description will be omitted.

Figure 20:
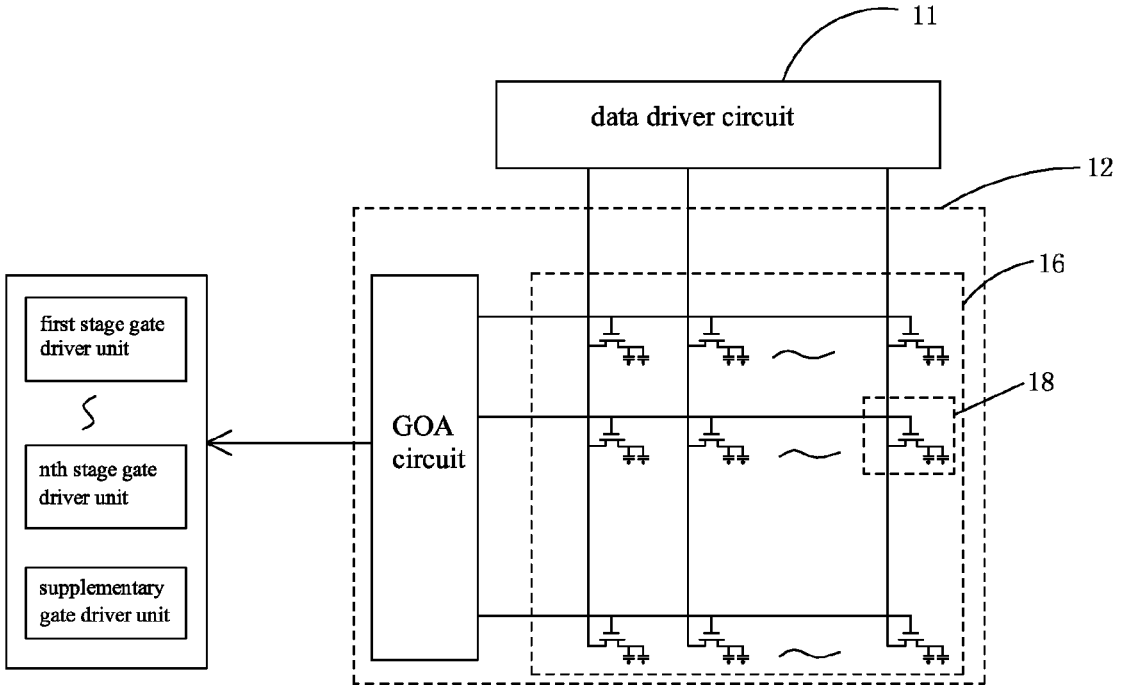
FIG. 20 is a schematic view showing a display panel with the GOA circuit according to the present invention.

Referring to FIG. 20, with additional reference to FIGS. 1-19, the present invention provides a display panel comprising the GOA circuit. The display panel can be a liquid crystal display panel or an OLED display panel, which comprises a data driver circuit 11 and a display panel body 12. The display panel body 12 comprises the above-described GOA circuit and a display panel pixel zone 16. The display panel pixel zone 16 comprises a plurality of pixel units 18 arranged as an array.

In summary, the present invention provides a GOA circuit and a display panel with the GOA circuit. The circuit adopts a dual-pull-down architecture so that thin-film transistors contained in pull-down units and supplementary pull-down units of the circuit can be set in an operation environment featuring dual polarity electrical biasing to effectively suppress threshold voltage drifting of the thin-film transistors of the pull-down units and the supplementary pull-down units and extend the lifespan of circuit thereby making the circuit better meet the needs of large- and medium-sized display panels. Further, the circuit has a simple structure and reduced power consumption and is also fit to low temperature and high temperature operations.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A GOA (Gate Drive on Array) circuit, comprising multiple stages of the gate driver units and multiple stages of the supplementary gate driver units connected in cascade, wherein:

a nth stage gate driver unit comprises a (n−2)th signal input terminal, a (n+1)th signal input terminal, a (n+3)th signal input terminal, a high-frequency clock signal first input terminal, a low-frequency clock signal first input terminal, a low-frequency clock signal second input terminal, a low level input terminal, a first output terminal, and a second output terminal, wherein the first output terminal of the nth stage array substrate row driving unit functions to drive a pixel zone of a display panel;

a mth stage supplementary gate driver unit comprises a (m−1)th supplementary signal input terminal, a high-frequency clock signal first input terminal, a high-frequency clock signal second input terminal, a low-frequency clock signal first input terminal, a low-frequency clock signal second input terminal, a low level input terminal, a first supplementary output terminal, and a second supplementary output terminal;

when the nth stage gate driver unit is one of the fourth stage to the fourth last stage gate driver unit, the (n−2)th signal input terminal of the nth stage gate driver unit is electrically connected to the first output terminal of the (n−2)th stage gate driver unit; the (n+1)th signal input terminal of the nth stage gate driver unit is electrically connected to the second output terminal of the (n+1)th stage gate driver unit; the (n+3)th signal input terminal of the nth stage gate driver unit is electrically connected to the first output terminal of the (n+3)th stage gate driver unit; the first output terminal of the nth stage gate driver unit is electrically connected to the (n−2)th signal input terminal of the (n+2)th stage gate driver unit and the (n+3)th signal input terminal of the (n−3)th stage gate driver unit; and the second output terminal of the nth stage gate driver unit is electrically connected to the (n+1)th signal input terminal of the (n−1)th stage gate driver unit;

when the nth stage gate driver unit is the first stage gate driver unit, the (n−2)th signal input terminal of the nth stage gate driver unit functions to receive an input of a pulse excitation signal; the (n+1)th signal input terminal of the nth stage gate driver unit is electrically connected to the second output terminal of the (n+1)th stage gate driver unit; the (n+3)th signal input terminal of the nth stage gate driver unit is electrically connected to the first output terminal of the (n+3)th stage gate driver unit; the first output terminal of the nth stage gate driver unit is electrically connected to the (n−2)th signal input terminal of the (n+2)th stage gate driver unit; and the second output terminal of the nth stage gate driver unit is floating;

when the nth stage gate driver unit is the second stage gate driver unit, the (n−2)th signal input terminal of the nth stage gate driver unit functions to receive an input of a pulse excitation signal; the (n−1)th signal input terminal of the nth stage gate driver unit is electrically connected to the second output terminal of the (n+1)th stage gate driver unit; the (n+3)th signal input terminal of the nth stage gate driver unit is electrically connected to the first output terminal of the (n+3)th stage gate driver unit; the first output terminal of the nth stage gate driver unit is electrically connected to the (n−2)th signal input terminal of the (n+2)th stage gate driver unit; and the second output terminal of the nth stage gate driver unit is electrically connected to the (n+1)th signal input terminal of the (n−1)th stage gate driver unit;

when the nth stage gate driver unit is the third stage gate driver unit, the (n−2)th signal input terminal of the nth stage gate driver unit is electrically connected to the first output terminal of the (n−2)th stage gate driver unit; the (n+1)th signal input terminal of the nth stage gate driver unit is electrically connected to the second output terminal of the (n−1)th stage gate driver unit; the (n+3)th signal input terminal of the nth stage gate driver unit is electrically connected to the first output terminal of the (n+3)th stage gate driver unit; the first output terminal of the nth stage gate driver unit is electrically connected to the (n−2)th signal input terminal of the (n+2)th stage gate driver unit; and the second output terminal of the nth stage gate driver unit is electrically connected to the (n+1)th signal input terminal of the (n−1)th stage gate driver unit;

when the nth stage gate driver unit is the third last stage gate driver unit, the (n−2)th signal input terminal of the nth stage gate driver unit is electrically connected to the first output terminal of the (n−2)th stage gate driver unit; the (n+1)th signal input terminal of the nth stage gate driver unit is electrically connected to the second output terminal of the (n−1)th stage gate driver unit; the (n+3)th signal input terminal of the nth stage gate driver unit is electrically connected to the first supplementary output terminal of the first stage supplementary gate driver unit; the first output terminal of the nth stage gate driver unit is electrically connected to the (n−2)th signal input terminal of the (n+2)th stage gate driver unit and the (n+3)th signal input terminal of the (n−3)th stage gate driver unit; and the second output terminal of the nth stage gate driver unit is electrically connected to the (n+1)th signal input terminal of the (n−1)th stage gate driver unit;

when the nth stage gate driver unit is the second last stage gate driver unit, the (n−2)th signal input terminal of the nth stage gate driver unit is electrically connected to the first output terminal of the (n−2)th stage gate driver unit; the (n+1)th signal input terminal of the nth stage gate driver unit is electrically connected to the second output terminal of the (n+1)th stage gate driver unit; the (n+3)th signal input terminal of the nth stage gate driver unit is electrically connected to the first supplementary output terminal of the second stage supplementary gate driver unit; the first output terminal of the nth stage gate driver unit is electrically connected to the (n+3)th signal input terminal of the (n−3)th stage gate driver unit; and the second output terminal of the nth stage gate driver unit is electrically connected to the (n−1)th signal input terminal of the (n−1)th stage gate driver unit;

when the nth stage gate driver unit is the last stage gate driver unit, the (n−2)th signal input terminal of the nth stage gate driver unit is electrically connected to the first output terminal of the (n−2)th stage gate driver unit; the (n+1)th signal input terminal of the nth stage gate driver unit is electrically connected to the second supplementary output terminal of the first stage supplementary gate driver unit; the (n+3)th signal input terminal of the nth stage gate driver unit is electrically connected to the first supplementary output terminal of the third stage supplementary gate driver unit; the first output terminal of the nth stage gate driver unit is electrically connected the (n+3)th signal input terminal of the (n−3)th stage gate driver unit and the (m−1)th supplementary signal input terminal of the first stage supplementary gate driver unit; and the second output terminal of the nth stage gate driver unit is electrically connected to the (n+1)th signal input terminal of the (n−1)th stage gate driver unit;

when the mth stage supplementary gate driver unit is one of the fourth stage to the last stage supplementary gate driver unit, the (m−1)th supplementary signal input terminal of the mth stage supplementary gate driver unit is electrically connected to the first supplementary output terminal of the (m−1)th stage supplementary gate driver unit; the first supplementary output terminal of the mth stage supplementary gate driver unit is electrically connected to the (m−1)th supplementary signal input terminal of the (m+1)th stage supplementary gate driver unit; and the second supplementary output terminal is floating;

when the mth stage supplementary gate driver unit is the first stage supplementary gate driver unit, the (m−1)th supplementary signal input terminal of the mth stage supplementary gate driver unit is electrically connected to the first output terminal of the last stage gate driver unit; the first supplementary output terminal of the mth stage supplementary gate driver unit is electrically connected to the (m−1)th supplementary signal input terminal of the (m+1)th stage supplementary gate driver unit and the (n+3)th signal input terminal of the third last stage gate driver unit; and the second supplementary output terminal is electrically connected to the (n+1)th signal input terminal of the last stage gate driver unit;

when the mth stage supplementary gate driver unit is the second stage supplementary gate driver unit, the (m−1)th supplementary signal input terminal of the mth stage supplementary gate driver unit is electrically connected to the first supplementary output terminal of the (m−1)th stage supplementary gate driver unit; the first supplementary output terminal of the mth stage supplementary gate driver unit is electrically connected to the (m−1)th supplementary signal input terminal of the (m+1)th stage supplementary gate driver unit and the (n+3)th signal input terminal of the second last stage gate driver unit; and the second supplementary output terminal is floating;

when the mth stage supplementary gate driver unit is the third stage supplementary gate driver unit, the (m−1)th supplementary signal input terminal of the mth stage supplementary gate driver unit is electrically connected to the first supplementary output terminal of the (m−1)th stage supplementary gate driver unit; the first supplementary output terminal of the mth stage supplementary gate driver unit is electrically connected to the (m−1)th supplementary signal input terminal of the (m+1)th stage supplementary gate driver unit and the (n+3)th signal input terminal of the last stage gate driver unit; and the second supplementary output terminal is floating;

the nth stage gate driver unit of the GOA circuit further comprises:

a driving unit, which is electrically connected to the (n−2)th signal input terminal, the high-frequency clock signal first input terminal, the (n+3)th signal input terminal, the first output terminal, and the second output terminal; and a pull-down unit, which is electrically connected to the (n+1)th signal input terminal, the low-frequency clock signal first input terminal, the low-frequency clock signal second input terminal, the low level input terminal, and the driving unit;

the mth stage supplementary gate driver unit of the GOA circuit further comprises:

a supplementary driving unit, which is electrically connected to the (m−1)th supplementary signal input terminal, the high-frequency clock signal first input terminal, the high-frequency clock signal second input terminal, the first supplementary output terminal, and the second supplementary output terminal; and a supplementary pull-down unit, which is electrically connected to the low-frequency clock signal first input terminal, the low-frequency clock signal second input terminal, the low level input terminal, and the supplementary driving unit.

2. The GOA circuit as claimed in claim 1, wherein the low level input terminal receives an input signal that is a low level signal; the high-frequency clock signal first input terminal and the high-frequency clock signal second input terminal receive an input signal that is a first high-frequency clock signal, a second high-frequency clock signal, a third high-frequency clock signal, or a fourth high-frequency clock signal, in which the first high-frequency clock signal and the third high-frequency clock signal are of opposite phases, the second high-frequency clock signal and the fourth high-frequency clock signal are of opposite phases, and the first high-frequency clock signal and the third high-frequency clock signal are of waveforms that are identical in shape to but different in initial phase from waveforms of the second high-frequency clock signal and the fourth high-frequency clock signal;

when the input signal of the high-frequency clock signal first input terminal of the nth stage gate driver unit of the GOA circuit is the first high-frequency clock signal, the input signals of the high-frequency clock signal first input terminals of the (n+1)th stage, the (n+2)th stage, and the (n+3)th stage gate driver units are respectively the second, the third, and the fourth high-frequency clock signals;

when the input signals of the high-frequency clock signal first input terminal and the high-frequency clock signal second input terminal of the mth stage supplementary gate driver unit of the GOA circuit are respectively the kth and the (k−1)th clock signals, the input signals of the high-frequency clock signal first input terminal and the high-frequency clock signal second input terminal of the (m+1)th stage supplementary gate driver unit of the GOA circuit are respectively the (k−1)th and the kth clock signals, wherein the value of k is from 1 to 4 and when k is 1, the value of k−1 is set to 4, and when k is 4, the value of k+1 is set to 1;

the low-frequency clock signal first input terminal and the low-frequency clock signal second input terminal receive input signals that are respectively a first low-frequency clock signal and a second low-frequency clock signal, wherein the first low-frequency clock signal and the second low-frequency clock signal are of complementary voltages;

when the input signals of the low-frequency clock signal first input terminal and the low-frequency clock signal second input terminal of the nth stage gate driver unit of the GOA circuit are respectively the first low-frequency clock signal and the second low-frequency clock signal, the input signals of the low-frequency clock signal first input terminal and the low-frequency clock signal second input terminal of the (n+1)th stage gate driver unit are respectively the second low-frequency clock signal and the first low-frequency clock signal; and when the input signals of the low-frequency clock signal first input terminal and the low-frequency clock signal second input terminal of the mth stage supplementary gate driver unit of the GOA circuit are respectively the first low-frequency clock signal and the second low-frequency clock signal, the input signals of the low-frequency clock signal first input terminal and the low-frequency clock signal second input terminal of the (m+1)th stage supplementary gate driver unit are respectively the second low-frequency clock signal and the first low-frequency clock signal.

3. The GOA circuit as claimed in claim 1, wherein the driving unit comprises a capacitor, a first TFT (Thin-Film Transistor), a second TFT, and a third TFT; wherein the first TFT comprises a first gate terminal, a first source terminal, and a first drain terminal; the second TFT comprises a second gate terminal, a second source terminal, and a second drain terminal; the third TFT comprises a third gate terminal, a third source terminal, and a third drain terminal; the first gate terminal and the first drain terminal are electrically connected to the (n−2)th signal input terminal; the first source terminal is electrically connected to one end of the capacitor, the second gate terminal, the third drain terminal, the second output terminal, and the pull-down unit; the second drain terminal is electrically connected to the high-frequency clock signal first input terminal; the second source terminal is electrically connected to an opposite end of the capacitor, the first output terminal, and the pull-down unit; the third gate terminal is electrically connected to the (n+3)th signal input terminal; the third source terminal is electrically connected to the low level input terminal;

the supplementary driving unit comprises a supplementary capacitor, a twenty-first thin-film transistor, a twenty-second thin-film transistor, and a twenty-third thin-film transistor, wherein the twenty-first thin-film transistor comprises a twenty-first gate terminal, a twenty-first source terminal, and a twenty-first drain terminal; the twenty-second thin-film transistor comprises a twenty-second gate terminal, a twenty-second source terminal, and a twenty-second drain terminal; the twenty-third thin-film transistor comprises a twenty-third gate terminal, a twenty-third source terminal, and a twenty-third drain terminal; the twenty-first gate terminal, the twenty-first drain terminal, and the twenty-second drain terminal are electrically connected to the (m−1)th supplementary signal input terminal; the twenty-first source terminal is electrically connected to one end of the supplementary capacitor, the twenty-third gate terminal, the twenty-second source terminal, the second supplementary output terminal, and the supplementary pull-down unit; the twenty-second gate terminal is electrically connected to the high-frequency clock signal second input terminal; the twenty-third drain terminal is electrically connected to the high-frequency clock signal first input terminal; the twenty-third source terminal is electrically connected to an opposite end of the supplementary capacitor, the first supplementary output terminal, and the supplementary pull-down unit.

4. The GOA circuit as claimed in claim 3, wherein the pull-down unit comprises a first pull-down unit, a first pull-down signal generation unit, a second pull-down unit, and a second pull-down signal generation unit, wherein the first pull-down unit is electrically connected to the driving unit, the first pull-down signal generation unit, the second pull-down unit, and the low level input terminal; the first pull-down signal generation unit is electrically connected to the first pull-down unit, the low-frequency clock signal first input terminal, the low-frequency clock signal second input terminal, and the low level input terminal; the second pull-down unit is electrically connected to the driving unit, the second pull-down signal generation unit, the first pull-down unit, and the low level input terminal; and the second pull-down signal generation unit is electrically connected to the second pull-down unit, the low-frequency clock signal first input terminal, the low-frequency clock signal second input terminal, and the low level input terminal;

the first pull-down unit comprises a fourth TFT and a fifth TFT, wherein the fourth TFT comprises a fourth gate terminal, a fourth source terminal, and a fourth drain terminal; the fifth TFT comprises a fifth gate terminal, a fifth source terminal, and a fifth drain terminal; the fourth gate terminal and the fifth gate terminal are electrically connected to the first pull-down signal generation unit; the fourth drain terminal is electrically connected to the first source terminal, the one end of the capacitor, the second gate terminal, the third drain terminal, the second output terminal, the second pull-down signal generation unit, and the second pull-down unit; the fourth source terminal and the fifth source terminal are electrically connected to the low level input terminal; the fifth drain terminal is electrically connected to the second source terminal, the opposite end of the capacitor, the first output terminal, and the second pull-down unit;

the second pull-down unit comprises a sixth TFT and a seventh TFT, wherein the sixth TFT comprises a sixth gate terminal, a sixth source terminal, and a sixth drain terminal and the seventh TFT comprises a seventh gate terminal, a seventh source terminal, and a seventh drain terminal; the sixth gate terminal and the seventh gate terminal are electrically connected to the second pull-down signal generation unit; the sixth source terminal and the seventh source terminal are electrically connected to the low level input terminal; the sixth drain terminal is electrically connected to the first source terminal, the one end of the capacitor, the second gate terminal, the third drain terminal, the fourth drain terminal, the second output terminal, and the second pull-down signal generation unit; the seventh source terminal is electrically connected to the second source terminal, the opposite end of the capacitor, the first output terminal, and the fifth drain terminal;

the first pull-down signal generation unit comprises an eighth TFT, a ninth TFT, a tenth TFT, an eleventh TFT, and a twelfth TFT, wherein the eighth TFT comprises an eighth gate terminal, an eighth source terminal, and an eighth drain terminal; the ninth TFT comprises a ninth gate terminal, a ninth source terminal, and a ninth drain terminal; the tenth TFT comprises a tenth gate terminal, a tenth source terminal, and a tenth drain terminal; the eleventh TFT comprises an eleventh gate terminal, an eleventh source terminal, and an eleventh drain terminal; the twelfth TFT comprises a twelfth gate terminal, a twelfth source terminal, and a twelfth drain terminal; the eighth gate terminal, the eighth drain terminal, the ninth drain terminal, and the tenth gate terminal are electrically connected to the low-frequency clock signal second input terminal; the eighth source terminal is electrically connected to the ninth source terminal, the tenth drain terminal, the fourth gate terminal, and the fifth gate terminal; the tenth source terminal is electrically connected to the eleventh drain terminal and the twelfth drain terminal; the eleventh gate terminal is electrically connected to the first source terminal, the one end of the capacitor, the second gate terminal, the third drain terminal, the fourth drain terminal, the sixth drain terminal, and the second output terminal; the eleventh source terminal and the twelfth source terminal are electrically connected to the low level input terminal; the twelfth gate terminal is electrically connected to the (n+1)th signal input terminal; and the second pull-down signal generation unit comprises a fourteenth thin-film transistor, a fifteenth thin-film transistor, a sixteenth thin-film transistor, a seventeenth thin-film transistor, and an eighteenth thin-film transistor, wherein the fourteenth thin-film transistor comprises a fourteenth gate terminal, a fourteenth source terminal, and a fourteenth drain terminal; the fifteenth thin-film transistor comprises a fifteenth gate terminal, a fifteenth source terminal, and a fifteenth drain terminal; the sixteenth thin-film transistor comprises a sixteenth gate terminal, a sixteenth source terminal, and a sixteenth drain terminal; the seventeenth thin-film transistor comprises a seventeenth gate terminal, a seventeenth source terminal, and a seventeenth drain terminal; the eighteenth thin-film transistor comprises an eighteenth gate terminal, an eighteenth source terminal, and an eighteenth drain terminal; the fourteenth gate terminal, the fourteenth drain terminal, the fifteenth drain terminal, and the sixteenth gate terminal are electrically connected to the low-frequency clock signal first input terminal; the fourteenth source terminal is electrically connected to the fifteenth source terminal, the sixteenth drain terminal, the sixth gate terminal, and the seventh gate terminal; the sixteenth source terminal is electrically connected the seventeenth drain terminal and the eighteenth drain terminal; the seventeenth gate terminal is electrically connected to the eleventh gate terminal, the first source terminal, the one end of the capacitor, the second gate terminal, the third drain terminal, the fourth drain terminal, the sixth drain terminal, and the second output terminal; the seventeenth source terminal and the eighteenth source terminal are electrically connected to the low level input terminal; the eighteenth gate terminal is electrically connected to the (n+1)th signal input terminal.

5. The GOA circuit as claimed in claim 4, wherein the ninth gate terminal is electrically connected to the low-frequency clock signal first input terminal; and the fifteenth gate terminal is electrically connected to the low-frequency clock signal second input terminal.

6. The GOA circuit as claimed in claim 4, wherein the ninth gate terminal is electrically connected to the eighth source terminal, the ninth source terminal, the tenth drain terminal, the fourth gate terminal, and the fifth gate terminal; and the fifteenth gate terminal is electrically connected to the fourteenth source terminal, the fifteenth source terminal, the sixteenth drain terminal, the sixth gate terminal, and the seventh gate terminal.

7. The GOA circuit as claimed in claim 5, wherein the first pull-down signal generation unit further comprises a thirteenth thin-film transistor, wherein the thirteenth thin-film transistor comprises a thirteenth gate terminal, a thirteenth source terminal, and a thirteenth drain terminal; the thirteenth gate terminal is electrically connected to the first gate terminal, the first drain terminal, and the (n−2)th signal input terminal; the thirteenth drain terminal is electrically connected to the tenth source terminal, the eleventh drain terminal, and the twelfth drain terminal; the thirteenth source terminal is electrically connected to the low level input terminal; and the second pull-down signal generation unit further comprises a nineteenth thin-film transistor, wherein the nineteenth thin-film transistor comprises a nineteenth gate terminal, a nineteenth source terminal, and a nineteenth drain terminal; the nineteenth gate terminal is electrically connected to the thirteenth gate terminal, the first gate terminal, the first drain terminal, and the (n−2)th signal input terminal; the nineteenth drain terminal is electrically connected to the sixteenth source terminal, the seventeenth drain terminal, and the eighteenth drain terminal; the nineteenth source terminal is electrically connected to the low level input terminal.

8. The GOA circuit as claimed in claim 3, wherein the nth stage gate driver unit further comprises a (n−1)th stage signal input terminal and a third output terminal and when the nth stage gate driver unit is one of the second stage to the last stage gate driver unit, the (n−1)th stage signal input terminal of the nth stage gate driver unit is electrically connected to the third output terminal of the (n−1)th stage gate driver unit; when the nth stage gate driver unit is the first stage gate driver unit, the nth stage gate driver unit does not comprise the (n−1)th stage signal input terminal; when the nth stage gate driver unit is one of the first stage to the second last stage gate driver unit, the third output terminal of the nth stage gate driver unit is electrically connected to the (n−1)th stage signal input terminal of the (n−1)th stage gate driver unit; and when the nth stage gate driver unit is the last stage gate driver unit, the third output terminal of the nth stage gate driver unit is floating;

the pull-down unit comprises a first pull-down unit, a second pull-down unit, and a second pull-down signal generation unit, wherein the first pull-down unit is electrically connected to the driving unit, the (n−1)th stage signal input terminal, and the low level input terminal; the second pull-down unit is electrically connected to the driving unit, the second pull-down signal generation unit, the first pull-down unit, and the low level input terminal; the second pull-down signal generation unit is electrically connected to the driving unit, the second pull-down unit, the low-frequency clock signal first input terminal, the low-frequency clock signal second input terminal, and the low level input terminal;

the first pull-down unit comprises a fourth TFT and a fifth TFT, wherein the fourth TFT comprises a fourth gate terminal, a fourth source terminal, and a fourth drain terminal and the fifth TFT comprises a fifth gate terminal, a fifth source terminal, and a fifth drain terminal; the fourth gate terminal and the fifth gate terminal are electrically connected to the (n−1)th stage signal input terminal; the fourth drain terminal is electrically connected to the first source terminal, one end of the capacitor, the second gate terminal, the third drain terminal, the second output terminal, the second pull-down signal generation unit, and the second pull-down unit; the fourth source terminal and the fifth source terminal are electrically connected to the low level input terminal; the fifth drain terminal is electrically connected to the second source terminal, an opposite end of the capacitor, the first output terminal, and the second pull-down unit;

the second pull-down unit comprises a sixth TFT and a seventh TFTT7, wherein the sixth TFT comprises a sixth gate terminal, a sixth source terminal, and a sixth drain terminal and the seventh TFT comprises a seventh gate terminal, a seventh source terminal, and a seventh drain terminal; the sixth gate terminal is electrically connected to the second pull-down signal generation unit, the seventh gate terminal, and the third output terminal; the sixth drain terminal is electrically connected to the first source terminal, the one end of the capacitor, the second gate terminal, the third drain terminal, the fourth drain terminal, the second output terminal, and the second pull-down signal generation unit; the sixth source terminal and the seventh source terminal are electrically connected to the low level input terminal; the seventh drain terminal is electrically connected to the second source terminal, the opposite end of the capacitor, the first output terminal, and the fifth drain terminal; and the second pull-down signal generation unit comprises a fourteenth thin-film transistor, a fifteenth thin-film transistor, a sixteenth thin-film transistor, a seventeenth thin-film transistor, and an eighteenth thin-film transistor, wherein the fourteenth thin-film transistor comprises a fourteenth gate terminal, a fourteenth source terminal, and a fourteenth drain terminal; the fifteenth thin-film transistor comprises a fifteenth gate terminal, a fifteenth source terminal, and a fifteenth drain terminal; the sixteenth thin-film transistor comprises a sixteenth gate terminal, a sixteenth source terminal, and a sixteenth drain terminal; the seventeenth thin-film transistor comprises a seventeenth gate terminal, a seventeenth source terminal, and a seventeenth drain terminal; the eighteenth thin-film transistor comprises an eighteenth gate terminal, an eighteenth source terminal, and an eighteenth drain terminal; the fourteenth gate terminal, the fourteenth drain terminal, the fifteenth drain terminal, and the sixteenth gate terminal are electrically connected to the low-frequency clock signal first input terminal; the fourteenth source terminal is electrically connected to the fifteenth source terminal, the sixteenth drain terminal, the sixth gate terminal, the seventh gate terminal, and the third output terminal; the sixteenth source terminal is electrically connected to the seventeenth drain terminal and the eighteenth drain terminal; the seventeenth gate terminal is electrically connected to the first source terminal, the one end of the capacitor, the second gate terminal, the third drain terminal, the fourth drain terminal, and the sixth drain terminal; the seventeenth source terminal and the eighteenth source terminal are electrically connected to the low level input terminal; the eighteenth gate terminal is electrically connected to the (n+1)th signal input terminal.

9. The GOA circuit as claimed in claim 8, wherein the fifteenth gate terminal is electrically connected to the low-frequency clock signal second input terminal.

10. The GOA circuit as claimed in claim 8, wherein the fifteenth gate terminal is electrically connected to the fourteenth source terminal, the fifteenth source terminal, the sixteenth drain terminal, the sixth gate terminal, the seventh gate terminal, and the third output terminal.

11. The GOA circuit as claimed in claim 9, wherein the second pull-down signal generation unit further comprises a nineteenth thin-film transistor, wherein the nineteenth thin-film transistor comprises a nineteenth gate terminal, a nineteenth source terminal, and a nineteenth drain terminal; the nineteenth gate terminal is electrically connected to the first gate terminal, the first drain terminal, and the (n−2)th signal input terminal; the nineteenth drain terminal is electrically connected to the sixteenth source terminal, the seventeenth drain terminal, and the eighteenth drain terminal; and the nineteenth drain terminal is electrically connected to the low level input terminal.

12. The GOA circuit as claimed in claim 3, wherein the supplementary pull-down unit comprises a first supplementary pull-down unit, a first supplementary pull-down signal generation unit, a second supplementary pull-down unit, and a second supplementary pull-down signal generation unit, wherein the first supplementary pull-down unit is electrically connected to the supplementary driving unit, the first supplementary pull-down signal generation unit, the second supplementary pull-down unit, and the low level input terminal; the first supplementary pull-down signal generation unit is electrically connected to the first supplementary pull-down unit, the low-frequency clock signal first input terminal, the low-frequency clock signal second input terminal, and the low level input terminal; the second supplementary pull-down unit is electrically connected to the supplementary driving unit, the second supplementary pull-down signal generation unit, the first supplementary pull-down unit, and the low level input terminal; the second supplementary pull-down signal generation unit is electrically connected to the second supplementary pull-down unit, the low-frequency clock signal first input terminal, the low-frequency clock signal second input terminal, and the low level input terminal.

13. The GOA circuit as claimed in claim 12, wherein the first supplementary pull-down unit comprises a twenty-fourth thin-film transistor and a twenty-fifth thin-film transistor, wherein the twenty-fourth thin-film transistor comprises a twenty-fourth gate terminal, a twenty-fourth source terminal, and a twenty-fourth drain terminal and the twenty-fifth thin-film transistor comprises a twenty-fifth gate terminal, a twenty-fifth source terminal, and a twenty-fifth drain terminal; the twenty-fourth gate terminal is electrically connected to the first supplementary pull-down signal generation unit and the twenty-fifth gate terminal; the twenty-fourth drain terminal is electrically connected to the twenty-first source terminal, the twenty-second source terminal, the one end of the supplementary capacitor, the twenty-third gate terminal, the second supplementary output terminal, the second supplementary pull-down signal generation unit, and the second supplementary pull-down unit; the twenty-fifth drain terminal is electrically connected to the opposite end of the supplementary capacitor, the first supplementary output terminal, and the second supplementary pull-down unit; the twenty-fifth source terminal is electrically connected to the low level input terminal; and the second supplementary pull-down unit comprises a twenty-sixth thin-film transistor and a twenty-seventh thin-film transistor, wherein the twenty-sixth thin-film transistor comprises a twenty-sixth gate terminal, a twenty-sixth source terminal, and a twenty-sixth drain terminal and the twenty-seventh thin-film transistor comprises a twenty-seventh gate terminal, a twenty-seventh source terminal, and a twenty-seventh drain terminal; the twenty-sixth gate terminal is electrically connected to the second supplementary pull-down signal generation unit and the twenty-seventh gate terminal; the twenty-sixth drain terminal is electrically connected to the twenty-fourth source terminal, the twenty-first source terminal, the twenty-second source terminal, the one end of the supplementary capacitor, the twenty-third gate terminal, the second supplementary output terminal, and the second supplementary pull-down signal generation unit; the twenty-seventh drain terminal is electrically connected to the opposite end of the supplementary capacitor, the first supplementary output terminal, the twenty-fifth drain terminal, and the twenty-third source terminal; the twenty-seventh source terminal is electrically connected to the low level input terminal.

14. The GOA circuit as claimed in claim 13, wherein the twenty-fourth source terminal is electrically connected to the low level input terminal; and the twenty-sixth source terminal is electrically connected to the low level input terminal.

15. The GOA circuit as claimed in claim 13, wherein the twenty-fourth source terminal is electrically connected to the twenty-fifth drain terminal, the opposite end of the supplementary capacitor, the first supplementary output terminal, and the second supplementary pull-down unit; and the twenty-sixth source terminal is electrically connected to the twenty-seventh drain terminal, the opposite end of the supplementary capacitor, the first supplementary output terminal, the twenty-fifth drain terminal, and the twenty-third source terminal.

16. The GOA circuit as claimed in claim 13, wherein the first supplementary pull-down signal generation unit comprises a twenty-eighth thin-film transistor, a twenty-ninth thin-film transistor, a thirtieth thin-film transistor, and a thirty-first thin-film transistor, wherein the twenty-eighth thin-film transistor comprises a twenty-eighth gate terminal, a twenty-eighth source terminal, and a twenty-eighth drain terminal; the twenty-ninth thin-film transistor a the twenty-ninth gate terminal, a twenty-ninth source terminal, and a twenty-ninth drain terminal; the thirtieth thin-film transistor comprises a thirtieth gate terminal, a thirtieth source terminal, and a thirtieth drain terminal; the thirty-first thin-film transistor comprises a thirty-first gate terminal, a thirty-first source terminal, and a thirty-first drain terminal; the twenty-eighth gate terminal, the twenty-eighth drain terminal, the twenty-ninth drain terminal and the thirtieth gate terminal are electrically connected to the low-frequency clock signal second input terminal; the twenty-eighth source terminal is electrically connected to the twenty-ninth source terminal, the thirtieth drain terminal, the twenty-fourth gate terminal, and the twenty-fifth gate terminal; the thirtieth source terminal is electrically connected to the thirty-first drain terminal; the thirty-first gate terminal is electrically connected to the twenty-first source terminal, the twenty-second source terminal, the one end of the supplementary capacitor, the twenty-third gate terminal, the second supplementary output terminal, the twenty-sixth drain terminal, and the twenty-fourth drain terminal electrically connected; the thirty-first source terminal is electrically connected to the low level input terminal; and the second supplementary pull-down signal generation unit comprises a thirty-second thin-film transistor, a thirty-third thin-film transistor, a thirty-fourth thin-film transistor, and a thirty-fifth thin-film transistor, wherein the thirty-second thin-film transistor comprises a thirty-second gate terminal, a thirty-second source terminal, and a thirty-second drain terminal; the thirty-third thin-film transistor comprises a thirty-third gate terminal, a thirty-third source terminal, and a thirty-third drain terminal; the thirty-fourth thin-film transistor comprises a thirty-fourth gate terminal, a thirty-fourth source terminal, and a thirty-fourth drain terminal; the thirty-fifth thin-film transistor comprises a thirty-fifth gate terminal, a thirty-fifth source terminal, and a thirty-fifth drain terminal; the thirty-second gate terminal, the thirty-second drain terminal, the thirty-third drain terminal, and the thirty-fourth gate terminal are electrically connected to the low-frequency clock signal first input terminal; the thirty-second source terminal is electrically connected to the thirty-third source terminal, the thirty-fourth drain terminal, the twenty-sixth gate terminal, and the twenty-seventh gate terminal; the thirty-fourth source terminal is electrically connected to the thirty-fifth drain terminal; the thirty-fifth gate terminal is electrically connected to the thirty-first gate terminal, the twenty-first source terminal, the twenty-second source terminal, the one end of the supplementary capacitor, the twenty-third gate terminal, the second supplementary output terminal, the twenty-sixth drain terminal, and the twenty-fourth drain terminal; the thirty-fifth source terminal is electrically connected to the low level input terminal.

17. The GOA circuit as claimed in claim 16, wherein the twenty-ninth gate terminal is electrically connected to the low-frequency clock signal first input terminal; and the thirty-third gate terminal is electrically connected to the low-frequency clock signal second input terminal.

18. The GOA circuit as claimed in claim 16, wherein the twenty-ninth gate terminal is electrically connected to the twenty-eighth source terminal, the twenty-ninth source terminal, the thirtieth drain terminal, the twenty-fourth gate terminal, and the twenty-fifth gate terminal; the thirty-third gate terminal is electrically connected to the thirty-second source terminal, the thirty-third source terminal, the thirty-fourth drain terminal, the twenty-sixth gate terminal, and the twenty-seventh gate terminal.

19. A display panel with a GOA circuit, comprising a data driver circuit and a display panel body, the display panel body comprising a GOA circuit as claimed in claim 1 and a display panel pixel zone, the display panel pixel zone comprising a plurality of pixel units arranged in an array.

* * * * *